US012129637B2

(12) United States Patent
Cummings et al.

(10) Patent No.: US 12,129,637 B2
(45) Date of Patent: Oct. 29, 2024

(54) URINAL SYSTEM, WATER CONSUMER SYSTEM HAVING A URINAL SYSTEM, AND METHOD FOR OPERATING A URINAL SYSTEM

(71) Applicants: Caroma Industries Limited, North Sydney (AU); micas AG, Oelsnitz (DE)

(72) Inventors: Stephen John Cummings, East Mona Vale (AU); Michael Fritzsche, Erzgebirge (DE); Mark Ebert, Erzgebirge (DE)

(73) Assignees: Caroma Industries Limited, North Sydney (AU); micas AG, Oelsnitz (DE)

( * ) Notice: Subject to any disclaimer, the term of this patent is extended or adjusted under 35 U.S.C. 154(b) by 122 days.

(21) Appl. No.: 17/761,770

(22) PCT Filed: Sep. 18, 2020

(86) PCT No.: PCT/AU2020/050990
§ 371 (c)(1),
(2) Date: Mar. 18, 2022

(87) PCT Pub. No.: WO2021/051167
PCT Pub. Date: Mar. 25, 2021

(65) Prior Publication Data

US 2022/0333363 A1 Oct. 20, 2022

(30) Foreign Application Priority Data

Sep. 20, 2019 (DE) ..... 10 2019 125 370.5

(51) Int. Cl.
*E03D 5/10* (2006.01)
*E03D 13/00* (2006.01)

(52) U.S. Cl.
CPC ..... *E03D 5/105* (2013.01); *E03D 13/005* (2013.01)

(58) Field of Classification Search
CPC ..... E03D 13/005; E03D 5/105
See application file for complete search history.

(56) References Cited

U.S. PATENT DOCUMENTS 6,250,601 B1 * 6/2001 Kolar ..... G01S 7/41 251/129.04
10,941,552 B2 * 3/2021 Grody ..... E03D 5/105
(Continued)

FOREIGN PATENT DOCUMENTS

CN 1764779 A 4/2006
CN 101666112 A 3/2010
(Continued)

*Primary Examiner* — Janie M Loeppke
(74) *Attorney, Agent, or Firm* — Seed IP Law Group LLP

(57) ABSTRACT

The invention relates to a urinal system (10), a water consumer system having such a urinal system, and a method for operating a urinal system. A urinal controller (8) of the urinal system has a data processing system (9) and/or is connected to a data processing system (9) which is designed to retrieve and/or receive and computationally evaluate data captured by at least one HF motion sensor (5) provided on a urinal bowl (1) and/or a urinal outlet (4) of the urinal system, and to recognize one of the following malfunctions based on the evaluated data and/or to initiate an action in order to avoid one of the following malfunctions: that the urinal outlet is obstructed, and/or that there is a pressure fluctuation in a wastewater system connected to the urinal system, and/or that a fluid inlet (2) and/or an inlet valve (3) of the urinal system is malfunctioning, and/or that there is a failure of the HF motion sensor, and/or to recognize a predefined urinal usage situation and/or frequency of use on the basis of the evaluated data and, based on this, to adapt an opening time and/or an opening position and/or an opening frequency of the inlet valve to in a subsequent urinal flushing process.

23 Claims, 6 Drawing Sheets

(56) References Cited

U.S. PATENT DOCUMENTS

| | | | | |
|---|---|---|---|---|
| 2005/0028260 | A1 | 2/2005 | Ling | |
| 2009/0070922 | A1 | 3/2009 | Murata et al. | |
| 2011/0114202 | A1 | 5/2011 | Goseco | |
| 2017/0275863 | A1 | 9/2017 | Tanogashira et al. | |
| 2018/0010322 | A1 | 1/2018 | Grover et al. | |
| 2020/0392710 | A1* | 12/2020 | Saruta | G01F 23/802 |

FOREIGN PATENT DOCUMENTS

| | | | |
|---|---|---|---|
| CN | 204185926 | U | 3/2015 |
| DE | 196 08 157 | A1 | 7/1997 |
| DE | 102 61 283 | A1 | 2/2004 |
| EP | 0 597 286 | A1 | 5/1994 |
| EP | 0 783 058 | A2 | 7/1997 |
| EP | 1 586 713 | A1 | 10/2005 |
| EP | 2 166 164 | A1 | 3/2010 |
| EP | 2 649 246 | B1 | 8/2017 |
| JP | 2003-56046 | A | 2/2003 |
| JP | 2010-236229 | A | 10/2010 |
| JP | 2019-60186 | A | 4/2019 |
| JP | 2020-12250 | A | 1/2020 |
| JP | 2020-12251 | A | 1/2020 |
| WO | 2006/042053 | A2 | 4/2006 |
| WO | 2008/017314 | A1 | 2/2008 |
| WO | 2009/061857 | A2 | 5/2009 |
| WO | 2016/062765 | A1 | 4/2016 |
| WO | 2016/100886 | A1 | 6/2016 |
| WO | 2019/143905 | A1 | 7/2019 |
| WO | 2019/163202 | A1 | 8/2019 |

* cited by examiner

URINAL SYSTEM, WATER CONSUMER SYSTEM HAVING A URINAL SYSTEM, AND METHOD FOR OPERATING A URINAL SYSTEM

TECHNICAL FIELD

The present invention relates to a urinal system having a urinal bowl, a fluid inlet with an inlet valve, a urinal outlet, at least one HF motion sensor provided on the urinal bowl and/or the urinal outlet, and a urinal controller coupled to the at least one HF motion sensor and to the inlet valve. The present invention also relates to a water consumer system having a urinal system according to the invention. In addition, the invention relates to a method for operating a urinal system having a urinal bowl, a fluid inlet with an inlet valve, a urinal outlet, at least one HF motion sensor provided on the urinal bowl and/or the urinal outlet, and a urinal controller coupled to the at least one HF motion sensor and to the inlet valve, by means of which the inlet valve is opened for a predetermined time when the at least one HF motion sensor detects draining fluid.

BACKGROUND

Particularly in public facilities such as theaters, sports facilities, restaurants, schools and universities, as well as in larger office complexes and similar high-traffic buildings, urinals are often equipped with automatic and contactless flushing due to the large number of users. Different sensor methods can be used to detect the usage. With high traffic, obstructions or other malfunctions of the urinal can often occur, which are often only recognized very late by a user or through regular maintenance and which, until they are recognized, can lead to unnecessarily high water consumption or insufficient cleaning of the urinal.

The detection of a possible use of a urinal by a proximity sensor which triggers an automatic flush when a user is present is very common. Such a system is described in the document EP 0 597 286 A1. The disadvantage is that the sensor used cannot register whether the person approaching has actually used the urinal. If the person only recognizes at the moment they are standing in front of the urinal that it is obstructed, for example, then they will not use it; however, a flush would still be triggered, which can possibly even lead to the obstructed urinal bowl overflowing.

Another way of detecting the use of a urinal is the use of capacitive sensors.

The document WO 2008/017314 A1 describes a method and a device for contactless triggering of a flush in urinal systems, having an electrically controllable water valve using a capacitive sensor attached to the collecting bowl or to the drainage pipe of the urinal, which is electrically connected to an electronic central control and evaluation unit such as a microcontroller. If the sensor detects the intended use of the urinal due to a capacitance of the sensor that changes when a fluid is introduced, thereby acting on the accordingly modified dielectric conditions, the sensor sends a sensor signal to the control and evaluation unit, whereupon the valve is opened by means of the control and evaluation unit, and then a flush is initiated. After each flushing operation of the urinal, either the sensor value of the sensor signal or the switching threshold is recalibrated after a selectable time, and thus is adapted to the changed conditions of the urinal after the flushing operation.

Document DE 102 61 283 A1 discloses a urinal in which contactless and automatic flushing is triggered after a structure on the outer side of and above an outlet of a urinal, which forms an electrical capacitor, registers the use of the urinal via a change in capacitance of the capacitor. Malfunctions of the urinal, such as obstruction of the urinal outlet or malfunctions of the inlet valve, cannot be registered by the structure described, since an evaluation only takes place via the formation of an average value from a large number of measured values of the single capacitor.

Document EP 1 586 713 A1 addresses a device and a method for automatically triggering a flushing device by means of a capacitive sensor, the device having a water seal which has an inlet, an outlet and an overflow edge. A capacitive sensor with at least one electrode is arranged on an outside of the water seal. The at least one electrode is arranged in front of the overflow edge in the region of the surface of the sealing water, seen in the direction of flow.

A sanitary system with a central mixing control is known from the document EP 2 649 246 B1, which is connected on the inlet side to a hot water line and a cold water line and on the outlet side to a plurality of mixed lines leading to consumers. The sanitary system uses a control center that controls a controllable mixing unit based on parameter values such as temperature, pressure, flow rate and/or flow quantity. Appropriate sensors are provided for determining the parameter values.

Document WO 2009/061857 A2 proposes a method for automatically generating work orders for a toilet, whereby not only states of a large number of device sensors, but also states of a non-device sensor are captured and these states are used to determine the state of a device, which has no sensor. In particular, the need for replenishing consumables is calculated.

In the document US 2011/0114202 A1, a valve in a water supply line is closed by means of a control when an unusual water flow rate is detected by a sensor located in the water supply line, and is opened again after a waiting period.

The immediate detection of a malfunction of a urinal and/or the correct assignment of a malfunction of a urinal to a specific cause is often problematic. For example, when the urinal is flushed, the water flowing from the fluid inlet via the urinal ceramic to the urinal outlet passes the urinal outlet after a certain delay. In some urinal systems, such a delay can be caused, for example, by a hydraulic delay in the inlet valve, the path to be covered by hoses/pipes between the inlet valve and the fluid inlet, or by reservoir devices. However, a malfunctioning inlet valve or an at least partially obstructed urinal outlet can also lead to delays. With known urinal systems, the specific cause of the problem can usually only be determined by a sanitary technician or service employee, despite the sensors used.

SUMMARY

It is therefore the object of the present invention to increase the functionality of the urinal system mentioned at the outset, the water consumer system mentioned at the outset, and the methods mentioned above.

The object is achieved on the one hand by a urinal system having a urinal bowl, a fluid inlet with an inlet valve, a urinal outlet, at least one HF motion sensor for detecting fluid motion provided on the urinal bowl and/or the urinal outlet, and a urinal controller coupled with the at least one HF motion sensor and the inlet valve, wherein the urinal controller has a data processing system and/or is connected to a data processing system which is designed to retrieve and/or receive data captured by at least one HF motion sensor, to evaluate it computationally and, based on the evaluated data, to detect at least one of the following malfunctions, and/or initiate at least one action in order to avoid at least one of the following malfunctions:

that the urinal outlet is obstructed, and/or that there is a pressure fluctuation in a wastewater system connected to the urinal system, and/or that the fluid inlet and/or the inlet valve is/are malfunctioning, and/or that at least one of the at least one HF motion sensors has failed, and/or to recognize a predefined urinal usage situation and/or frequency of use on the basis of the evaluated data and, on the basis thereof, to adapt an opening time and/or an opening position and/or an opening frequency of the inlet valve in at least one subsequent urinal flushing process.

The urinal system according to the invention can have a urinal bowl or a plurality of urinal bowls.

The at least one HF motion sensor is preferably arranged on the urinal bowl and/or the urinal outlet in such a way that it can detect flowing fluids in the region of a drain of the urinal bowl. The at least one HF motion sensor is preferably arranged on the rear side of the urinal bowl in the immediate spatial vicinity of the urinal outlet. In particular, the at least one HF motion sensor itself or at least one holding device comprising the at least one HF motion sensor is glued, bolted, or otherwise fastened to the rear of the urinal bowl.

The at least one HF motion sensor preferably does not point in the direction of a sealing water in an odor trap of the urinal outlet. The arrangement and alignment of the motion sensor advantageously ensures that it is able to detect the flush water flowing from the fluid inlet to the urinal outlet during a urinal flushing process and/or the urine hitting and/or flowing out of the urinal bowl when the urinal system is used.

The data acquired by the at least one HF motion sensor are retrieved and/or received by the data processing system contained in the urinal controller or connected to it. The data is preferably transmitted via a wireless or mesh data transmission network, such as via Bluetooth, for example, and particularly preferably via Bluetooth mesh. This advantageously enables communication with a mobile device, which has the advantage of a simplified operating function and simple setting and diagnosis options. It is also advantageous that communication with a building control via a cloud or a building management system is made possible, which in particular simplifies the retrieving of operating data or the display of service requirements. Another advantage of data transmission using a wireless or mesh data transmission network is the ability to communicate with other sensor products either directly in a network or indirectly via at least one gateway.

The data processing system has either predetermined reference values or, after a certain period of use of the urinal system, empirical values and/or its own operating data, for example with regard to the usual draining times associated with a urinal flushing process. Deviations from the reference values and/or empirical values are registered and at least one action is triggered to prevent the cause of the deviation. In addition to the operating data of a single HF motion sensor, the data processing system can also receive data from other sensors, such as, for example, from pressure and/or flow sensors in a water supply system and/or a wastewater disposal system of the urinal system, or from a building control.

A possible action to be triggered by the data processing system can be, for example, adapting the opening time and/or the opening position and/or the opening frequency of the inlet valve and/or sending an error message and/or a service message.

The inlet valve can, for example, be a solenoid valve with a defined opening time and/or opening position and/or opening frequency, which is activated by the urinal controller.

If the urinal outlet is obstructed, fluid accumulates in the urinal bowl. If the sensor region of the urinal bowl is completely filled with fluid, the at least one HF motion sensor typically no longer detects any water flow, since the HF motion sensor can usually not penetrate the fluid. In this situation, the data processing system no longer recognizes use and does not trigger a new flush—that is to say, the inlet valve does not open again. In addition to reducing the opening frequency of the inlet valve to zero, an obstruction can be reported to a mobile device or a building control.

Alternatively, a sensory detection of the obstruction is also possible in that the HF motion sensor not only detects the motion in the urinal bowl, but can also distinguish between empty urinal bowls and, for example, filled urinal bowls, at least up to a marking. A signal analysis of the HF motion sensor is preferably carried out for this purpose. The strong reflection in the vicinity of the HF motion sensor leads to changed signal levels, even if the urinal bowl is full—such as a shift in the offset voltage of the HF motion sensor. This effect arises from a change in the phase position of the reflected signal from the HF motion sensor, due to the distance and/or material properties of the reflecting standing fluid in the vicinity of the HF motion sensor.

Alternatively, a standing fluid within the urinal bowl can be detected with the aid of another sensor method. In particular, another HF sensor method suitable for detecting static objects can be used, for example using at least one frequency modulated continuous wave radar (FMCW), at least one capacitive sensor and/or at least one other suitable sensor or sensor system.

The malfunction that the urinal outlet is obstructed, which is to be avoided according to the invention using the data processing system, includes a partial or beginning obstruction, as well as a complete obstruction of the urinal outlet.

If an obstruction is starting to form, the draining times at or in the urinal outlet are extended, as a result of which the HF motion sensor registers longer-lasting motion and/or a lower flow rate. A deviation of the draining times from empirical and/or reference values that are preferably stored, but can also be input, is recognized (or determined) by the data processing system and leads to an error message and/or service message being sent.

The data processing system is advantageously able to recognize (or determine) when no running water is registered by the HF motion sensor after a flush has taken place. Advantageously in this case, on the one hand, no further flushing process is triggered until a new motion is detected; on the other hand, an error message and/or a service message is preferably sent.

In the event of a pressure fluctuation in a wastewater system connected to the urinal system, for example due to an improper or malfunctioning installation, such as insufficient ventilation of the wastewater pipe, strong pressure fluctuations occur during a flushing process, which can lead to fluctuating water levels in the water seal or even emptying. If such a fluctuation is sensed as a motion by the HF motion sensor, incorrect flushing can be triggered. The data processing system preferably recognizes a motion triggered by a fluctuating water level as such and does not trigger a new flushing process. One possible action is sending an error message and/or a service message and/or preventing a new flushing process. Such a faulty motion signal can be detected by a signal analysis with reference to the signal profile of the typical sensor signals, which, as explained above, can be based on empirical values and/or reference values. These oscillations of this signal profile should settle down during a regular flushing process.

In the event of a malfunction in the fluid inlet, it may be that the HF motion sensor no longer registers any motion because the valve does not open and no fluid flows, that the HF motion sensor permanently registers motion because the valve does not close completely, or that the HF motion sensor registers a reduced amount of fluid because the valve only opens incompletely and only a reduced amount of water is released during the flushing process. The action triggered by the data processing system is then advantageously the sending of an error message and/or a service message.

If the HF motion sensor registers a permanent flow of fluid, the water supply of the urinal system can be interrupted according to the invention by activating a shut-off valve, preferably via a wireless or mesh data transmission network—such as, for example, via Bluetooth or Bluetooth mesh.

It is particularly advantageous if the urinal controller activates the at least one HF motion sensor permanently or at a certain predetermined time interval with pulses. If at least one of the at least one HF motion sensors fails, the data processing system detects a lack of response to the pulses and sends an error message and/or service message.

The data processing system is preferably designed to recognize (or determine) a predefined urinal usage situation and/or frequency of use on the basis of the evaluated data and, based on this, to adapt an opening time and/or an opening position and/or an opening frequency of the inlet valve in at least one subsequent urinal flushing process.

In this way, for example, times of high traffic can advantageously be identified, and suitable and effective water-saving programs activated for the given situation. For example, a flushing interval and/or a flushing volume can be adapted to a predicted number of users of the urinal system and, for example, a cleaning flushing can be triggered at suitable times with an increased flushing volume compared to the regular flushing process.

The urinal system preferably also has at least one pressure sensor and/or at least one flow sensor in the fluid inlet, and/or is coupled to at least one pressure sensor and/or at least one flow sensor in the fluid inlet via a mesh and/or wireless local data transmission network.

Advantageously, by combining the signals of at least one of the at least one HF motion sensors with the signals of the at least one pressure sensor and/or of the at least one flow sensor, a distinction can be made between different situations that lead to the same or similar reactions of at least one of the at least one HF motion sensors. The absence of a reaction of at least one of the at least one HF motion sensors to a previously triggered flushing can be attributed, for example, to the fact that a complete obstruction is present, and due to this, at least one of the at least one HF motion sensors is blind, to the fact that the inlet valve is not opening due to a valve malfunction or an electronics defect, or to the fact that there is a malfunction in the water supply.

The at least one pressure sensor in the fluid inlet is expediently able to detect whether there is a water supply, while the at least one flow sensor in the fluid inlet is able to detect whether water is flowing out of the fluid inlet or not. The corresponding situations can be recognized and distinguished from each other based on typical signal profiles of at least one of the at least one HF motion sensors in conjunction with data from the at least one pressure sensor and/or the at least one flow sensor in the fluid inlet, by means of a classifier or another suitable AI algorithm—that is, an algorithm using artificial intelligence.

The object is also achieved by a urinal system having a urinal bowl, a fluid inlet with an inlet valve, a urinal outlet, at least one HF motion sensor for detecting fluid motion provided on the urinal bowl and/or the urinal outlet, and a urinal controller coupled to the at least one HF motion sensor and the inlet valve, wherein the urinal system also has at least one pressure sensor and/or at least one flow sensor in the fluid inlet, and/or is coupled to at least one pressure sensor and/or at least one flow sensor in the fluid inlet via a mesh data transmission network, and the urinal controller has a data processing system, and/or is connected to a data processing system, which is designed to retrieve and/or receive data captured by at least one HF motion sensor and/or the at least one pressure sensor and/or the at least one flow sensor, to evaluate the same electronically, and to recognize (or determine) at least one of the following malfunctions on the basis of the evaluated data and/or to trigger at least one action in order to avoid at least one of the following malfunctions:

- that the urinal outlet is obstructed, and/or
- that there is a pressure fluctuation in a wastewater system connected to the urinal system, and/or
- that the pressure in the fluid inlet has dropped below a minimum pressure value, or has exceeded a maximum pressure value, and/or
- that the inlet valve is malfunctioning, and/or
- that at least one of the at least one HF motion sensors has failed, and/or to recognize (or determine) a predefined urinal usage situation and/or frequency of use on the basis of the evaluated data and, on the basis thereof, to adapt an opening time and/or an opening position and/or an opening frequency of the inlet valve in at least one subsequent urinal flushing process.

The urinal system according to the invention can have a urinal bowl or a plurality of urinal bowls.

The at least one HF motion sensor is preferably arranged on a rear side of the urinal bowl in the immediate spatial vicinity of the urinal outlet. The at least one HF movement sensor preferably does not point in the direction of a sealing water in the odor trap of the urinal drain.

Fluids flowing in and out in the region of the urinal outlet can be detected with the at least one HF motion sensor. The at least one HF motion sensor itself can be glued, screwed or otherwise fastened to the rear of the urinal bowl, or by means of at least one holding device having or holding the at least one HF motion sensor.

The arrangement and alignment of the motion sensor advantageously ensures that it is able to detect the motion of the flush water flowing from the fluid inlet to the urinal outlet during a urinal flushing process, and/or of the urine hitting and/or flowing out of the urinal bowl when the urinal system is used.

The urinal system according to the invention also has at least one pressure sensor and/or at least one flow sensor in the fluid inlet and/or is coupled to at least one pressure sensor and/or at least one flow sensor in the fluid inlet via a mesh network and/or a wireless local data transmission network.

The at least one pressure sensor in the fluid inlet advantageously detects whether there is a water supply, while the at least one flow sensor in the fluid inlet detects whether water is flowing out of the fluid inlet or not.

If the at least one pressure sensor reports the presence of a water supply at the same time as the at least one HF motion sensor does not register any flow motion during a flushing process, it is likely that either a complete obstruction is present, or a valve malfunction or an electronics malfunction has made it so that the inlet valve does not open. If the at least one flow sensor in the fluid inlet reports that water is flowing out of the fluid inlet during a flushing process, at the same time as the at least one HF motion sensor does not register any flow motion, the data processing system will assume complete obstruction as the most likely scenario.

Advantageously, by combining the signals of at least one of the at least one HF motion sensors with the signals of the at least one pressure sensor and/or of the at least one flow sensor, a distinction can be made between different situations that lead to the same or similar reactions of at least one of the at least one HF motion sensors. The corresponding situations can be recognized and distinguished from each other using typical signal profiles of at least one of the at least one HF motion sensors in connection with data from the at least one pressure sensor and/or the at least one flow sensor in the fluid inlet, for example with the aid of a classifier or another suitable AI algorithm.

Furthermore, by networking the urinal controller with at least one pressure and/or flow sensor or by directly integrating at least one pressure and/or flow sensor into the urinal system, the flushing time can be adapted as a function of an actual water pressure and/or flow, and thus the flushing volume can be adjusted much more precisely to the given urinal. If the water pressure or flow rate falls below a certain minimum for a certain time, the urinal system according to the invention can send an error message and/or a service message.

The urinal controller coupled to the inlet valve has a data processing system and/or is connected to a data processing system. The data captured by the at least one HF motion sensor is retrieved and/or received by the data processing system. The data is preferably transmitted via a wireless or mesh data transmission network, such as, for example, via Bluetooth or Bluetooth mesh. This advantageously enables communication with a mobile device, with a building control via a cloud or a building management system, and with other sensor products, either directly in the network or indirectly via at least one gateway. This is accompanied by the advantage of a simplified operating function as well as simple setting and/or diagnostic options and the simplification of retrieving operating data or displaying service requirements.

The data processing system registers deviations from predetermined reference values or from empirical values and/or a sensor's own operating data, for example with regard to the usual drainage times associated with a urinal flushing process or the amount of fluid flowing out during a flushing process. In the event deviations occur, the data processing system can initiate at least one action to prevent the cause of the given deviation. In addition to a single HF motion sensor's own operating data, the data processing system can use data from other sensors or from a building control. For example, break times in a public facility, such as a theater or a sports facility, or the business hours of a building, can be taken into account.

One possible action to be triggered by the data processing system to avoid a malfunction in the urinal system is, in particular, the adjustment of the opening time and/or the opening position and/or the opening frequency of the inlet valve, and/or the sending of an error message and/or a service message.

The inlet valve can, for example, be a solenoid valve with a defined opening time and/or opening position and/or opening frequency, which is activated by the urinal controller.

As already explained above, if the urinal outlet is completely obstructed, fluid will build up in the urinal bowl. Since the at least one HF motion sensor typically cannot penetrate the fluid, it no longer detects the flow of water as soon as the sensor region of the urinal bowl is completely filled with fluid. If the at least one flow sensor in the fluid inlet simultaneously reports a water flow and thus a flushing process occurring, the data processing system detects a possible obstruction and does not trigger a new flush—that is, the inlet valve does not open again. In addition, an error message and/or service message can be sent immediately.

A sensory detection of a complete obstruction is also possible by differentiating between a urinal that is filled with fluid completely, or up to a certain marking, and an empty urinal bowl with a regular water level in the water seal. Such a distinction can be made by means of a signal analysis of the HF motion sensor. As already explained further above, due to the distance and/or material properties of the reflecting standing fluid in the vicinity of the sensor, there is a change in the phase position of the reflected signal of the HF motion sensor. This leads to a shift in the offset voltage of the HF motion sensor and thus to modified signal levels, which in turn can be recognized (or determined) by the data processing system.

Alternatively, the standing fluid can be detected using a different sensor method. In particular, another HF sensor method suitable for detecting static objects can be used—for example utilizing at least one frequency modulated continuous wave radar (FMCW), at least one capacitive sensor, and/or at least one other suitable sensor or sensor system.

If the urinal system is only beginning to become obstructed, in the urinal system according to the invention the HF motion sensor registers at least one extended draining time over a longer period of time. In the case of a partial obstruction, the same amount of flush water would require a longer draining time than if there was no obstruction. If the data processing system detects such a deviation from empirical and/or reference values, it triggers at least one action to prevent further deviations. Such an action can be the sending of an error message and/or a service message and/or the prevention of further flushing processes.

In the event of a pressure fluctuation in a wastewater system connected to the urinal system, for example due to improper installation, such as inadequate ventilation of the wastewater line, strong pressure fluctuations occur during a flushing process. This in turn can lead to a fluctuating water level in the water seal, or even to the water seal being removed by suction. If such a fluctuation is sensed as a motion by the at least one HF motion sensor, incorrect flushing may be triggered. The data processing system preferably recognizes a motion triggered by a fluctuating water level as such and does not trigger a new flushing process. One possible action is sending an error message and/or a service message and/or preventing a new flushing process. Such a faulty motion signal can be recognized by a signal analysis of the typical sensor signals based on empirical values and/or reference values with regard to the signal profile. These oscillations of this signal profile should settle down during a regular flushing process.

There can be different scenarios in the event of a malfunction in the fluid inlet. For example, it may be that the at least one HF motion sensor no longer registers any motion if the valve does not open and no fluid is flowing. The at least one HF motion sensor may also permanently register motion in the event that the valve does not close completely. It is also possible for the at least one HF motion sensor to register a reduced amount of fluid if the valve only opens incompletely and only a reduced amount of water is released during the flushing process. The action triggered by the data processing system is advantageously the sending of an error message and/or service message.

If the at least one HF motion sensor registers a permanent flow of fluid, the water supply of the urinal system according to the invention can be interrupted by activating a shut-off valve, preferably via a wireless or mesh data transmission network, such as, for example, via Bluetooth or Bluetooth mesh.

Advantageously, the urinal controller activates the at least one HF motion sensor permanently, or at a certain predetermined time interval with pulses. If at least one of the at least one HF motion sensors fails, the absence of a reaction to the pulses is recognized (or determined) and an error message and/or a service message is sent.

The data processing system is preferably designed to recognize (or determine) a predefined urinal usage situation and/or frequency of use on the basis of the evaluated data and, based on this, to adapt an opening time and/or an opening position and/or an opening frequency of the inlet valve in at least one subsequent urinal flushing process.

In this way, for example, times of high traffic can advantageously be identified, and suitable and effective water-saving programs activated for the given situation. For example, a flushing interval and/or a flushing volume can be adapted to a predicted number of users of the urinal system, and a cleaning flushing can be triggered at suitable times with an increased flushing volume compared to a regular flushing process.

The urinal system according to the invention preferably has an error message and/or service message output unit coupled to the data processing system. In the event of an error or malfunction detected by the data processing system, the error message and/or service message output unit is instructed to issue an error message and/or a service message, which advantageously significantly shortens the period of time until the error or malfunction is recognized by a user and/or a service employee.

In an advantageous embodiment, the data processing system has at least one data processing block with machine learning, or comprising an artificial neural network, and/or containing an expert system.

By using the at least one data processing block with machine learning, or comprising an artificial neural network, and/or containing an expert system, the data processing system of the urinal system according to the invention is advantageously able to make intelligent decisions based on its own operating data and additional data from other sensors or from a building control. In this way, for example, water consumption and/or convenience can be optimized for the user or users, and the amount of actions which must be carried out by people, for example to maintain the urinal system, can be reduced.

The implementation of AI algorithms, that is to say algorithms using artificial intelligence, is preferably carried out directly in at least one of the at least one HF motion sensors as so-called "embedded AI." At least one microcontroller connected to the HF motion sensor preferably has the resources required for this, such as a suitably large memory, a corresponding computing power, and/or availability of further suitable tools.

The object is further achieved by a water consumer system having a urinal system according to the invention, wherein the water consumer system according to the invention has, in addition to the urinal system, at least one further water consumer on which at least one further sensor is provided, wherein the data processing system is coupled to the at least one further sensor and is designed to likewise computationally evaluate the data captured by the at least one further sensor and received by the data processing system, and to include this data in the error or malfunction detection and/or error or malfunction prevention.

The water consumer system according to the invention can have a urinal system or a plurality of urinal systems, wherein the urinal system or the urinal systems can each have one urinal bowl or a plurality of urinal bowls.

The at least one further water consumer is preferably a sink or a toilet, or at least one further urinal system.

The at least one further sensor can be at least one infrared motion or proximity sensor, at least one capacitive motion or proximity sensor, at least one contactless push plate, at least one temperature sensor, and/or at least one HF motion or proximity sensor. For example, the at least one temperature sensor can also be used to detect the use of a toilet or urinal by detecting a temperature change caused by a flow of urine in a toilet or urinal.

The at least one other sensor can also be used independently of the urinal system, for example to recognize (or determine) an obstruction in the at least one further water consumer, such as a sink or a toilet. In this case it is possible, but not necessary, for the respective further water consumer to be controlled by means of the at least one further sensor.

Furthermore, it is possible to use the at least one additional sensor to inform the urinal controller of the urinal system of the water consumer system according to the invention that, for example, a toilet in an adjacent room is being flushed, whereby a slight pressure fluctuation transmitted to the urinal controller by means of a pressure sensor can be traced back to this flushing process.

For example, the at least one further sensor related to the further water consumer on which it is provided can also be simply an obstruction sensor that detects an obstruction of the given water consumer. Such an obstruction can, however, be reported by the at least one further sensor to the urinal controller and/or to at least one further control of one of the other water consumers.

The at least one further sensor can be arranged at the outlet of the further water consumer, and/or at a different position.

The data that is captured by the at least one further sensor on the at least one further water consumer can, according to the invention, be transmitted to the data processing system and/or the urinal controller. As a result, the data processing system and/or the urinal controller learns that, for example, a toilet is flushing and that pressure fluctuations in the drain and/or in the wastewater system can occur.

My means of the at least one further sensor, interactions in the water consumer system can also be sensed, and these can be incorporated by the urinal controller. For example, as mentioned above, flushing a toilet or another urinal can lead to pressure fluctuations in the urinal outlet of the urinal system. Accordingly, an incorrect flushing of the urinal system can be prevented. This applies accordingly to other usage situations that can be recognized with the additional use of data from the further sensor.

If there is a pressure fluctuation in a wastewater system connected to the water consumer system, for example due to improper installation, such as insufficient ventilation of the wastewater pipe, strong pressure fluctuations occur during a flushing process, wherein these can lead to fluctuating water levels in the water seal or in the water seals of the urinal system or urinal systems and/or of the at least one further water consumer of the water consumer system, including emptying said water seal by suction. If such a fluctuation is recognized as a motion by at least one of the at least one HF motion sensors, incorrect flushing may be triggered.

The data processing system preferably recognizes a motion triggered by a fluctuating water level as such and does not trigger a new flushing process. One possible action is sending an error message and/or service message and/or preventing a new flushing process. This type of incorrect motion signal can be detected by a signal analysis of the typical sensor signals based on empirical values and/or reference values with regard to the signal profile. The oscillations of this signal profile should settle down during a regular flushing process. In addition, data from other motion sensors in the water consumer system can be evaluated, wherein the time at which other urinals or toilets were flushed in relation to the signal from the HF motion sensor of the respective urinal system can be noted.

The water consumers and the urinal system are preferably connected to each other via a mesh network and/or a wireless local data transmission network.

This connection and a communication based on it between the water consumers and the urinal system is particularly preferably carried out on the basis of a wireless or mesh data transmission network, such as Bluetooth or Bluetooth mesh. Advantageously, this form of connection enables the water consumer system to communicate with a mobile device, which has the advantage of a simplified operating function and simple adjustment and diagnosis options. It is also advantageous if the water consumer system can communicate with a building control via a cloud or a building management system, which in particular simplifies the retrieving of operating data or the display of service requirements. Another advantage of data transmission using a wireless or mesh data transmission network, such as Bluetooth or Bluetooth mesh, is the ability to communicate with other sensor products either directly in the network or indirectly via at least one gateway.

The object is further achieved by a method for operating a urinal system having a urinal bowl, a fluid inlet with an inlet valve, a urinal outlet, at least one HF motion sensor for detecting fluid motion provided on the urinal bowl and/or the urinal outlet, and a urinal controller which is coupled to the at least one HF motion sensor and the inlet valve and by means of which the inlet valve is opened for a predetermined time when the at least one HF motion sensor detects draining fluid, wherein, according to the invention, the urinal controller has a data processing system and/or is connected to a data processing system that queries and/or receives at least data captured by the at least one HF motion sensor, evaluates it by computing, and recognizes on the basis of the evaluated data if at least one of the following malfunctions is present, and/or triggers at least one action to avoid at least one of the following malfunctions:

that the urinal outlet is obstructed, and/or that there is a pressure fluctuation in a wastewater system connected to the urinal system, and/or that the fluid inlet and/or the inlet valve is/are malfunctioning, and/or that at least one of the at least one HF motion sensors has failed, and/or recognizes a predefined urinal usage situation and/or frequency of use on the basis of the evaluated data and, based on this, adapts an opening time and/or opening position and/or an opening frequency of the inlet valve thereto in at least one subsequent urinal flushing process.

The urinal system operated with the method according to the invention can have a urinal bowl or a plurality of urinal bowls.

The inlet valve of the urinal system operated with the method according to the invention is preferably a solenoid valve with a defined opening time and/or opening position and/or opening frequency, which is activated by the urinal controller of the urinal system operated by the method according to the invention.

As already explained above, the at least one HF motion sensor is preferably arranged on the urinal bowl and/or the urinal outlet in such a way that it is able to detect the motion of the flush water flowing from the fluid inlet to the urinal outlet during a urinal flushing process, and/or urine hitting the urinal bowl during use of the urinal system.

The at least one HF motion sensor is preferably fastened to the rear of the urinal bowl directly or by means of a holding device, in particular glued to the rear of the urinal bowl. The at least one HF motion sensor is preferably oriented in such a way that it does not point in the direction of a sealing water located in the odor trap of the urinal outlet. By arranging the at least one HF motion sensor in the immediate spatial vicinity of the urinal outlet, the at least one HF motion sensor can advantageously detect draining fluid.

The data acquired by the at least one HF motion sensor is retrieved and/or received by the data processing system, preferably via a wireless or mesh data transmission network, such as Bluetooth or Bluetooth mesh. This advantageously enables communication with a mobile device, with a building control via a cloud or a building management system and with other sensor products either directly in the network or indirectly via gateways. This is accompanied by the advantage of a simplified operating function, as well as simple setting and diagnosis options and the simplification of retrieving operating data or displaying service requirements.

The data processing system registers deviations from predetermined reference values or from empirical values or a sensor's own operating data, for example with regard to the usual drainage times associated with a urinal flushing process or the amount of fluid flowing out during a flushing process. In the event deviations occur, the data processing system can initiate at least one action to prevent the cause of the given deviation. In addition to a single HF motion sensor's own operating data, the data processing system can use data from other sensors or from a building control. For example, break times in a public facility such as a theater or a sports facility, or the business hours of a building can be taken into account.

One possible action to be triggered by the data processing system to avoid a malfunction in the urinal system is, in particular, the adjustment of the opening time and/or the opening position and/or the opening frequency of the inlet valve, and/or the sending of an error message and/or a service message.

Attention is hereby directed to the entirety of the foregoing explanations with regard to the detection of deviations in the sensor signals in the event of a complete or partial obstruction, a pressure fluctuation in a wastewater system connected to the urinal, a malfunction in the fluid inlet, a failure of at least one of the at least one HF motion sensors, and also the actions to be triggered by the data processing system in each case.

The detection of a predefined urinal usage situation and/or frequency of use and reaction to this also takes place as described above.

An embodiment of the method according to the invention is preferred in which, in the fluid inlet, a fluid pressure is detected with at least one pressure sensor and/or a fluid flow is detected with at least one flow sensor, the detected fluid pressure and/or the detected fluid flow is/are transmitted to the data processing system, and the data processing system computationally evaluates the detected fluid pressure and/or the detected fluid flow with the data retrieved and/or received from the at least one HF motion sensor, and recognizes on the basis of the evaluated data if at least one of the following malfunctions is present, and/or triggers at least one action to avoid at least one of the following malfunctions:

- that the urinal outlet is obstructed, and/or
- that there is a pressure fluctuation in a wastewater system connected to the urinal system, and/or
- that the pressure in the fluid inlet has dropped below a minimum pressure value, or has exceeded a maximum pressure value, and/or
- that the fluid inlet and/or the inlet valve is/are malfunctioning, and/or
- that at least one of the at least one HF motion sensors has failed, and/or recognizes a predefined urinal usage situation and/or frequency of use on the basis of the evaluated data and, based on the same, adapts an opening time and/or an opening position and/or an opening frequency of the inlet valve in at least one subsequent urinal flushing process.

Advantageously, by the computational evaluation of the data from the at least one pressure sensor and/or the at least one flow sensor with respect to the data from at least one of the at least one HF motion sensors, different malfunctions can be distinguished that lead to identical or similar reactions from at least one of the at least one HF motion sensors.

The absence of a reaction of at least one of the at least one HF motion sensors to a previously triggered flushing can be attributed, for example, to the fact that a complete obstruction is present, and due to this, at least one of the at least one HF motion sensors is blind, to the fact that the inlet valve is not opening due to a valve malfunction or an electronics defect, or to the fact that there is a malfunction in the water supply. If at least one pressure sensor reports an existing optimal fluid pressure at the same time, a malfunction in the water supply can be ruled out. If the at least one flow sensor reports at the same time that there is an inflow of fluid, the data processing system will assume an obstruction of the urinal outlet as the most likely scenario, and can trigger corresponding actions, as already described above.

The evaluation of the sensor data by the data processing system is preferably carried out using a classifier or another suitable AI algorithm by comparing typical signal profiles of at least one of the at least one HF motion sensors in connection with data from the at least one pressure sensor and/or the at least one flow sensor in the fluid inlet.

The data processing system advantageously directly recognizes when pressure in the fluid inlet drops below a minimum pressure value, or exceeds a maximum pressure value, by evaluating the data from the at least one pressure sensor. The data processing system can then trigger appropriate actions, such as preventing a further flushing process and/or sending an error message and/or service message.

Attention is hereby directed to the entirety of the foregoing explanations with regard to the detection of deviations in the sensor signals from at least one of the at least one HF motion sensors in the event of a complete or partial obstruction, a pressure fluctuation in a wastewater system connected to the urinal, a malfunction in the fluid inlet, a failure of at least one of the at least one HF motion sensors, and also the actions to be triggered by the data processing system in each case.

The detection of a predefined urinal usage situation and/or urinal frequency and reaction to this can also take place as described above.

The object is also achieved by a method for operating a urinal system having a urinal bowl, a fluid inlet with an inlet valve, a urinal outlet, at least one HF motion sensor for detecting fluid motion provided on the urinal bowl and/or the urinal outlet, and a urinal controller which is coupled to the at least one HF motion sensor and the inlet valve and by means of which the inlet valve is opened for a predetermined time when the at least one HF motion sensor detects draining fluid, wherein, according to the invention, in the fluid inlet a fluid pressure is detected with at least one pressure sensor and/or a fluid flow is detected with at least one flow sensor, and the urinal controller has a data processing system and/or is connected to a data processing system that queries and/or receives data captured by the at least one HF motion sensor and/or the at least one pressure sensor and/or the at least one flow sensor, evaluates it by computing, and recognizes on the basis of the evaluated data if at least one of the following malfunctions is present, and/or triggers at least one action to avoid at least one of the following malfunctions:

- that the urinal outlet is obstructed, and/or
- that there is a pressure fluctuation in a wastewater system connected to the urinal and/or
- that the pressure in the fluid inlet has dropped below a minimum pressure value, or has exceeded a maximum pressure value, and/or
- that the fluid inlet and/or the inlet valve is/are malfunctioning, and/or
- that there is a failure of at least one of the at least one HF motion sensors.

Advantageously, by the computational evaluation of the data from the at least one pressure sensor and/or the at least one flow sensor with respect to the data from at least one of the at least one HF motion sensors, different malfunctions can be distinguished that lead to identical or similar reactions from at least one of the at least one HF motion sensors. In this regard, reference is made to the entirety of the foregoing explanations.

The data processing system preferably detects that the urinal outlet is obstructed and/or the fluid inlet is malfunctioning if, despite the open inlet valve, the at least one HF motion sensor detects no running fluid and/or the at least one HF motion sensor detects that at least a lower region within the urinal bowl is filled with standing fluid.

Advantageously, the data processing system can trigger an immediate action to prevent the urinal bowl from overflowing. Such an action can be the prevention of a further flushing process and/or the sending of an error message and/or service message.

In particular, the data processing system detects whether the urinal outlet is obstructed or the fluid inlet is malfunctioning if, despite the open inlet valve and the fluid pressure detected by the at least one pressure sensor and/or the fluid flow detected by the at least one flow sensor, the at least one HF motion sensor detects no running fluid, and/or the fact that at least a lower region within the urinal bowl is filled with standing fluid is detected by means of the at least one HF motion sensor.

With regard to the detection of deviations in the sensor signals from at least one of the at least one HF motion sensors in the event of a complete obstruction, reference is made to the entirety of the foregoing explanations.

The combination of the data from the at least one pressure sensor with the data from the at least one flow sensor and the data from the at least one HF motion sensor advantageously allows a possible malfunction to be localized more precisely. As already described above, the absence of a reaction of at least one of the at least one HF motion sensors to a previously triggered flush can be attributed, for example, to the fact that there is a complete obstruction, and due to this at least one of the at least one HF motion sensors is blind, to the fact that the inlet valve is not opening due to a valve malfunction or an electronic malfunction, or to the fact that there is a malfunction in the water supply. If at least one pressure sensor reports an existing optimal fluid pressure at the same time, a malfunction in the water supply can be ruled out. If the at least one flow sensor reports at this time that there is an inflow of fluid, the data processing system will assume an obstruction of the urinal outlet as the most likely scenario and can trigger appropriate actions, as already described above.

The data processing system preferably detects that the urinal outlet is partially obstructed and/or the fluid inlet is malfunctioning if, despite the open inlet valve, the at least one HF motion sensor detects that fluid is draining from the urinal bowl with a time delay.

With regard to the detection of deviations in the sensor signals from at least one of the at least one HF motion sensors in the event of a partial obstruction, as well as the combination of the data from at least one of the at least one HF motion sensors with the data from the at least one flow sensor, reference is hereby made to the entirety of the foregoing explanations.

In a further preferred embodiment, the data processing system recognizes whether the urinal outlet is partially obstructed or the fluid inlet is malfunctioning if, despite the inlet valve being open and fluid pressure detected by the at least one pressure sensor and/or the fluid flow detected by the at least one flow sensor, the at least one HF motion sensor detects that fluid is draining from the urinal bowl with a time delay.

With regard to the detection of deviations in the sensor signals from at least one of the at least one HF motion sensors in the event of a partial obstruction, as well as the combination of the data from at least one of the at least one HF motion sensors with the data from the at least one flow sensor and/or the data from the at least one pressure sensor, reference is hereby made to the entirety of the foregoing explanations.

In the method according to the invention, the specific opening time of the inlet valve is preferably adapted by the urinal controller in the entire pressure and/or flow range to the specific fluid pressure and/or the specific fluid flow in the fluid inlet—that is, the respective flushing volume is regulated.

In advantageous embodiments of the method according to the invention, when it is recognized that the pressure in the fluid inlet has fallen below a minimum value or has exceeded a maximum pressure value, in addition to the adaptation of the opening time of the inlet valve to the fluid pressure and/or the fluid flow in the fluid inlet, the data processing system and/or the urinal controller issues an error message or service message. In the present invention, the permitted pressure range is, for example, 2 to 8 bar.

In the case of the present invention, the specific opening time of the inlet valve during flushing is preferably continuously adapted to determined pressure and/or flow values. In the event of lower pressure and/or flow values, the inlet valve is opened for a longer period of time in order to ensure a sufficient flow of water and thus sufficient cleaning of the urinal bowl. For higher pressure and/or flow values, the inlet valve is opened for a shorter time in order to avoid unnecessarily high water consumption.

If the pressure falls below a minimum value, such as below 2 bar, for example, and/or exceeds a maximum pressure value such as 8 bar, for example, a service or error message is preferably output by the data processing system and/or the urinal controller.

The data processing system preferably detects that the fluid inlet is malfunctioning when the at least one HF motion sensor detects no fluid flow and/or a permanent fluid flow and/or a fluid flow below a fluid flow threshold value.

In the event of a malfunction in the fluid inlet, the result may be that the HF motion sensor no longer registers any motion because the valve does not open and no fluid flows, that the HF motion sensor permanently registers motion because the valve does not close completely, or that the HF motion sensor registers a reduced amount of fluid because the valve only opens incompletely and only a reduced amount of water is released during the flushing process.

If the HF motion sensor registers a permanent flow of fluid, the water supply of the urinal system according to the invention can be interrupted by controlling a shut-off valve, preferably via a wireless or mesh data transmission network such as Bluetooth or Bluetooth mesh, in order to avoid unnecessarily high water consumption or fluid overflow.

If the at least one HF motion sensor does not detect a flow of fluid over a longer period of time, the data processing system can be used to check whether the at least one HF motion sensor has failed. Advantageously, the urinal controller activates the at least one HF motion sensor permanently, or at a certain predetermined time interval with pulses. If the at least one HF motion sensor fails, the absence of a reaction to the pulses is recognized and an error message and/or a service message is sent.

In a preferred embodiment of the method according to the invention, the urinal system has an error message and/or service message output unit coupled to the data processing system, and the data processing system outputs a service message to the error message and/or service message output unit when it detects at least one of the malfunctions.

This advantageously significantly shortens the period of time until the malfunction is recognized by a user and/or a service employee. An error message and/or service message can, for example, be sent directly to a smartphone or another mobile device or a building control.

The data processing system preferably recognizes that there is a pressure fluctuation in the wastewater system connected to the urinal bowl if a series of successive incorrect urinal flushing processes in the urinal system is found in the profile of the data from the at least one HF motion sensor, and/or if a signal pattern of the data from the at least one HF motion sensor corresponds to a characteristic fluctuation of the fluid level in the urinal outlet.

As already explained above, in the event of a pressure fluctuation in a wastewater system connected to the urinal system, for example due to improper installation, such as insufficient ventilation of the wastewater line, strong pressure fluctuations during a flushing process can lead to fluctuations in the water level in the water seal up to and including emptying of the water seal by suction. If such a fluctuation is sensed as a motion by the HF motion sensor, incorrect flushing can be triggered. The data processing system preferably recognizes a motion triggered by a fluctuating water level as such.

In particular, when the data processing system detects that there is a pressure fluctuation in a wastewater system connected to the urinal system, the urinal controller changes a sensitivity of the at least one HF motion sensor, and/or does not trigger a urinal flushing process if a signal pattern of the data from the at least one HF motion sensor corresponds to a characteristic fluctuation of the fluid level in the urinal outlet.

By changing the sensitivity of the at least one HF motion sensor, in one embodiment of the method according to the invention, a fluctuating water level triggered by pressure fluctuations is not recognized as regular use. This advantageously avoids incorrect flushing and the associated unnecessary increase in water consumption.

The prevention of further urinal flushing processes when a characteristic fluctuation of the fluid level in the urinal outlet is detected also ensures that unnecessarily increased water consumption is avoided.

The data processing system preferably has at least one data processing block that learns by machine learning, and/or works on the basis of an artificial neural network and/or is an expert system.

The data processing system is thereby advantageously able to make intelligent decisions based on its own operating data and additional data from other sensors or from a building control system. In this way, for example, water consumption and/or convenience can be optimized for the user, and/or the amount of human intervention can be reduced.

In a preferred embodiment of the method according to the invention, the urinal system is integrated into a water consumer system which, in addition to the urinal system, has at least one further water consumer on which at least one further sensor is provided, wherein the data processing system is coupled to the at least one further sensor and likewise evaluates the data received from the at least one further sensor computationally, wherein at least one flushing time and/or obstruction in an outlet, and/or a pressure fluctuation in a wastewater system and/or a malfunction of an inlet device of the at least one further water consumer determined in this case is/are incorporated into the detection of at least one of the malfunctions.

The at least one further water consumer is, for example, a sink or a toilet, or at least one further urinal system.

The at least one further sensor can be at least one infrared motion or proximity sensor, at least one capacitive motion sensor, at least one contactless push plate, at least one temperature sensor and/or at least one HF motion or proximity sensor.

The at least one other sensor can also be used independently of the urinal system, for example to recognize (or determine) an obstruction on the at least one other water consumer, such as a washstand, a further urinal or a toilet. In this case it is possible, but not necessary, for the respective further water consumer to be controlled by means of the at least one further sensor.

For example, the at least one further sensor related to the further water consumer on which it is provided can be simply be an obstruction sensor that detects an obstruction of the given water consumer. Such an obstruction can, however, be reported by the at least one further sensor to the urinal controller and/or to at least one further control of one of the other water consumers.

My means of the at least one further sensor, interactions in the water consumer system can also be recognized, and these can be incorporated by the urinal controller. For example, flushing a toilet can lead to pressure fluctuations in the urinal outlet of the urinal system. Accordingly, an incorrect flushing of the urinal system can be prevented. This applies accordingly to other usage situations that can be recognized with the additional use of data from the further sensor.

The at least one further sensor can be arranged at the outlet of the further water consumer, and/or at a different position.

The data that is captured by the at least one further sensor on the at least one further water consumer can, according to the invention, be transmitted to the data processing system and/or the urinal controller. As a result, the data processing system and/or the urinal controller learns that, for example, a toilet is flushing and that pressure fluctuations in the drain and/or in the wastewater system can occur.

The combination of the data from several sensors advantageously enables functions that are not possible with a conventional sensor or are only possible through human decisions and human intervention. For example, typical usage situations can be recognized, times of high traffic can be identified, and suitable and effective water-saving programs can be activated for the given situation.

The determined flushing time of the at least one further water consumer can be used to identify a failure in the inlet of the urinal system. For example, an only-partially open inlet valve can result in deviations in the flushing times of the at least one additional water consumer.

An obstruction in the outlet of the at least one further water consumer or a malfunction of an inlet device of the at least one further water consumer can lead to more users resorting to the functioning urinal system, which leads to an increased frequency of use. In this case, suitable water-saving programs could be activated.

The water consumers and the urinal system preferably communicate with each other via a mesh network and/or a wireless local data transmission network.

This advantageously enables communication with a mobile device, which has the advantage of a simplified operating function as well as simple setting and diagnosis options. It is also advantageous that communication with a building control is made possible via a cloud or a building management system, which in particular simplifies the retrieving of operating data or the display of service requirements. Another advantage of data transmission using a wireless or mesh data transmission network, such as Bluetooth or Bluetooth mesh, is the ability to communicate with other sensor products either directly in the network or indirectly via gateways.

Furthermore, a failure of at least one of the at least one HF motion sensors preferably exists when the data processing system does not receive any data from at least one of the at least one HF motion sensors, or the data received by the data processing system from the at least one of the at least one HF motion sensors cannot be processed by the data processing system, and/or at least one of the at least one HF motion sensor outputs at least one service signal.

The urinal controller preferably activates the at least one HF motion sensor permanently or at a certain predetermined time interval with pulses. If at least one of the at least one HF motion sensors fails, the absence of a reaction to the pulses is recognized and an error message and/or a service message is sent.

A failure of at least one of the at least one HF motion sensors can thereby advantageously be distinguished from a longer period of non-use of the urinal.

BRIEF DESCRIPTION OF THE DRAWINGS

The invention is explained in more detail below with reference to exemplary embodiments and the associated figures, without being restricted to these.

In the figures.

DETAILED DESCRIPTION

Figure 1:
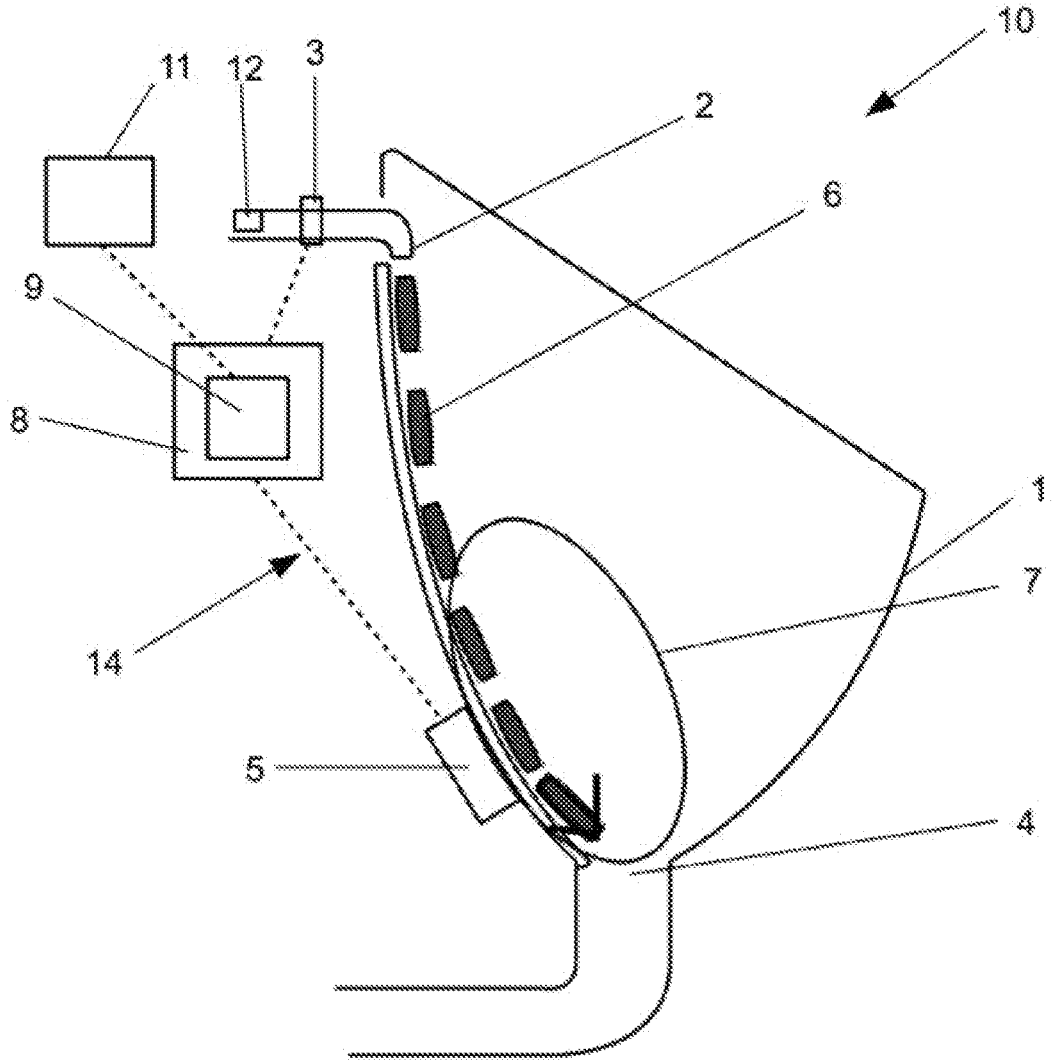
FIG. 1: is a schematic view of an embodiment of a urinal system according to the invention during a flushing process.

FIG. 1 is a schematic view of an embodiment of a urinal system 10 according to the invention during a flushing process.

The urinal system 10 has a urinal bowl 1 with a fluid inlet 2 and a urinal outlet 4.

An inlet valve 3 is provided on the fluid inlet 2, with which the fluid inlet 2 can be opened or closed. When the inlet valve 3 is open, flush water 6 flows from the fluid inlet 2 via the urinal bowl 1 to the urinal outlet 4.

In the exemplary embodiment shown, an HF motion sensor 5 is attached to the back of the urinal bowl 1. In other embodiments of the present invention, several HF motion sensors 5 can also be provided on the urinal bowl 1 and/or at the urinal outlet 4.

The HF motion sensor 5 is oriented in such a way that its capture field 7 is inside the urinal bowl 1. The HF motion sensor 5 is thus able to register a motion of flowing flush water 6 as soon as it passes the capture field 7 of the HF motion sensor 5.

The data captured by the HF motion sensor 5 is transmitted to a data processing system 9 of a urinal controller 8 of the urinal system 10 and evaluated computationally by the same. In the exemplary embodiment shown in FIG. 1, the data processing system 9 is a microcontroller integrated into the urinal controller 8; but in other embodiments of the invention, it can also be provided separately from the urinal controller 8 and be, for example, a cloud or a gateway. In the exemplary embodiment shown, the data processing system 9 is coupled to an error message and/or service message output unit 11.

If at least one malfunction in the urinal system 10 is recognized on the basis of this transmitted data, the data processing system 9 can trigger at least one corresponding action in order to prevent the at least one malfunction. Such an action can, for example, be preventing the inlet valve 3 from reopening, and/or sending an error message and/or service message to the error message and/or service message output unit 11.

In the embodiment of the invention shown in FIG. 1, a pressure sensor 12 is arranged in the fluid inlet 2. In other embodiments of the present invention, a flow sensor can also be arranged instead of the pressure sensor 12 or in addition to the pressure sensor 12. In addition, a plurality of pressure sensors 12 and/or flow sensors can also be arranged in the course of the fluid inlet 2. Furthermore, there are simple embodiments of the present invention in which the urinal system has neither a pressure sensor nor a flow sensor in the fluid inlet 2.

In the urinal system 10, urine flows into the urinal outlet 4 via the inside of the urinal bowl 1, which is typically made of ceramic. The flowing fluid, i.e. the urine, is recognized by the HF motion sensor 5. The HF motion sensor 5 sends a corresponding signal to the urinal controller 8, which opens the inlet valve 3 in the fluid supply line 2 for a certain time when a certain amount of fluid motion is detected, and thus triggers the urinal to be flushed.

For example, the inlet valve 3, which is, for example, a solenoid valve, is opened for about 2 to 8 seconds depending on the set flushing volume. After the inlet valve 3 is closed, the water continues to flow for a certain time, due to various effects:

- hydraulic delay of the inlet valve 3, which is typically on the order of 1 to 2 seconds, and/or
- slow replacement of fluid from hoses or pipes between the inlet valve 3 and the urinal inlet and/or a water reservoir, which can take place over a longer period of up to 30 seconds, and/or
- slow drainage of fluid from the ceramic surface of the urinal bowl 1, which can occur over a period of 5 to 10 seconds, and/or
- slow drainage of fluid due to a partially obstructed urinal outlet 4, which leads to a longer observation of the drainage of the fluid by the at least one HF motion sensor 5.

Because, in the present invention, motion data captured continuously or in stages by the at least one HF motion sensor 5 is transmitted to the urinal controller 8, according to the invention a typical behavior is learned by the data processing system 9 connected to or integrated into the urinal controller 8, wherein deviations from normal operation, such as a beginning obstruction due to slowly increasing drainage time of fluid at the urinal system 10, are recognized via a trend analysis carried out by the data processing system 9. In the present invention, environmental conditions such as cleaning processes in the urinal system 10 and/or a water pressure detected in the fluid supply line 2, must be taken into account.

Figure 2:
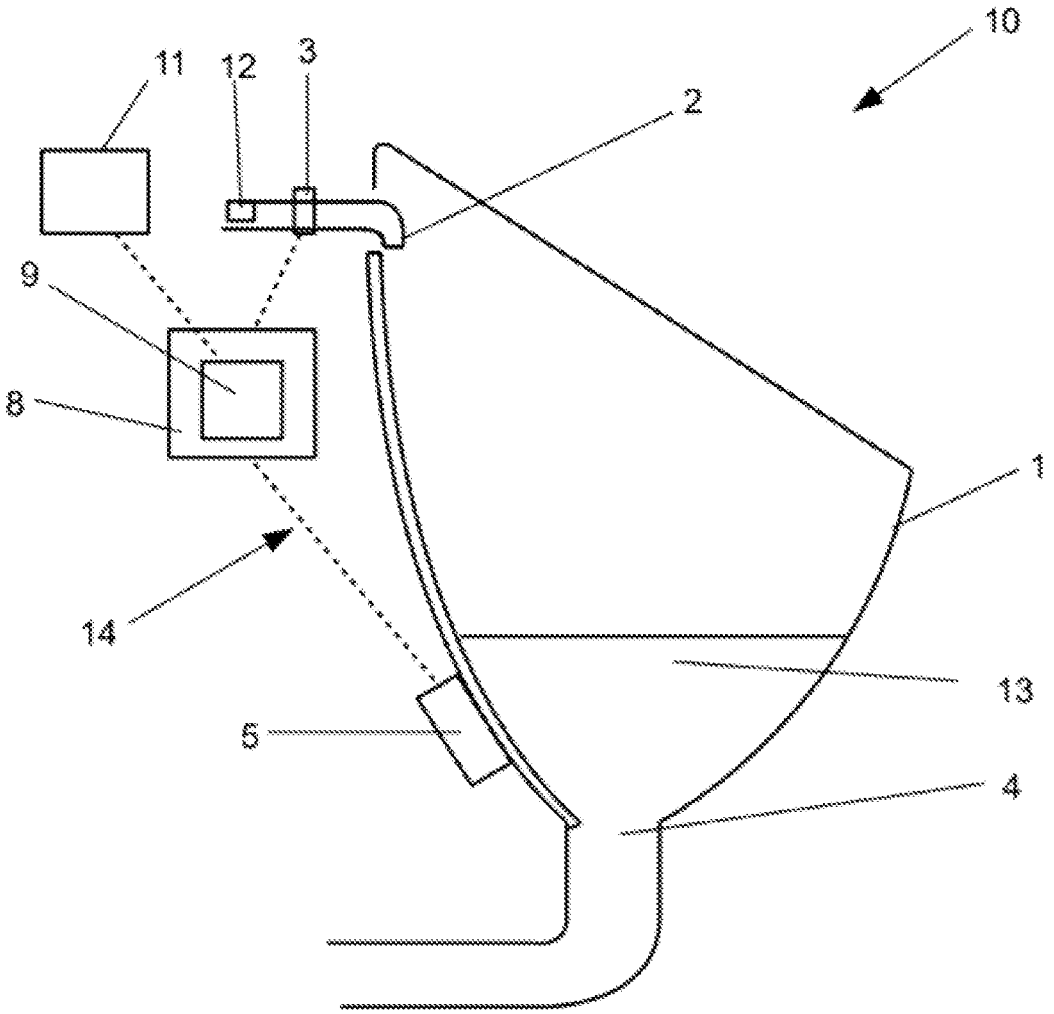
FIG. 2: is a schematic view of an embodiment of a urinal system according to the invention with a completely obstructed urinal outlet.

FIG. 2 shows a schematic view of a urinal system 10 designed as in FIG. 1, with a completely obstructed urinal outlet 4. In the urinal bowl 1, there is a fluid 13 above the obstructed urinal outlet 4. The detection area 7 of the HF motion sensor 5 shown in FIG. 1 is completely covered with the fluid 13 in the state shown in FIG. 2.

Since the HF motion sensor 5 cannot penetrate the fluid 13, it does not register any motion of the arriving urine, and accordingly does not register any use of the urinal. The data processing system 9 thus does not trigger any opening of the inlet valve 3 of the fluid inlet 2. In addition to preventing the inlet valve 3 from reopening, an obstruction can be reported to a mobile device or a building control.

Figure 3:
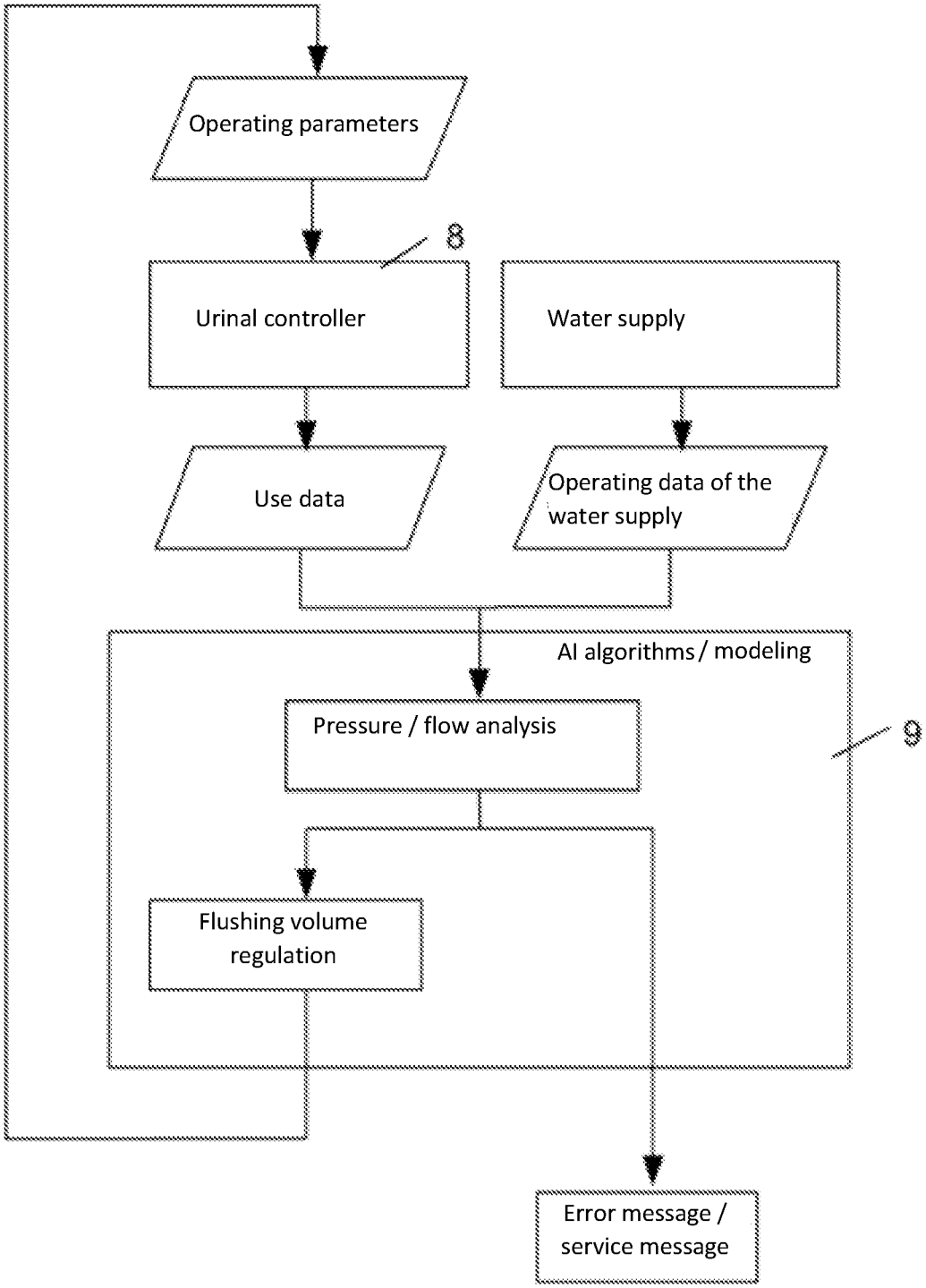
FIG. 3: is a flow diagram of a water pressure-adapted flush control of a urinal system according to the invention.

FIG. 3 shows a flow diagram of a flush control adapted to the water pressure of an embodiment of a urinal system 10 according to the invention, which can be designed similarly to the embodiment in FIGS. 1 and 2, which is why reference is made below to the reference numerals used in FIGS. 1 and 2.

The urinal controller 8 is coupled to at least one HF motion sensor 5 for detecting the use of the urinal system 10 and at least one actuator for triggering a flush. The at least one actuator is an inlet valve 3, which is designed as a solenoid valve in the exemplary embodiment shown. The urinal controller 8 captures usage data, among other things, via the at least one HF motion sensor 5. Based on this data, the urinal controller 8 determines, for example, the water consumption of the urinal system 10, usage statistics and/or a time profile of a usage process. For example, 8 flushes are counted by the urinal controller for this purpose, multiplied by the given flushing volume and, if necessary, pressure and/or flow values are added.

For the water supply of the urinal system 10, parameters such as the water pressure and/or the flow rate are detected as operating data of the water supply. For this purpose, the at least one pressure sensor 12 and/or the at least one flow sensor are arranged in the fluid inlet 2.

The usage data captured by the urinal controller 8 and the operating data of the water supply are transmitted to the data processing system 9 and used for computational evaluation. The computational evaluation is carried out using AI algorithms and/or modeling.

An analysis of the pressure and flow rate takes place in the data processing system 9. There is a recognition of overpressure or underpressure, a recognition of pressure fluctuations, pressure peaks and other problems of the water supply, and a recognition of trends. Furthermore, the data processing system 9 establishes a relationship with the usage data of the urinal system 10.

In the event of critical pressure conditions, such as overpressure or underpressure, an error message and/or service message is sent to the building operator, a plumber, a building management system, a cloud and/or the responsible water supplier. A warning or an alarm can also be triggered.

In the case of regular pressure conditions, a flushing volume regulation takes place in the urinal system 10 through the urinal controller 8. In this case, a flushing time in the urinal system 10 is adapted to a detected water pressure or a detected flow rate, with fluctuations and trends being taken into account. The aim is a proper flushing of the urinal system 10, as completely as possible. When the flushing time is adjusted, the operating parameters of the urinal system 10 are adjusted, and in turn are transmitted to the urinal controller 8.

Figure 4:
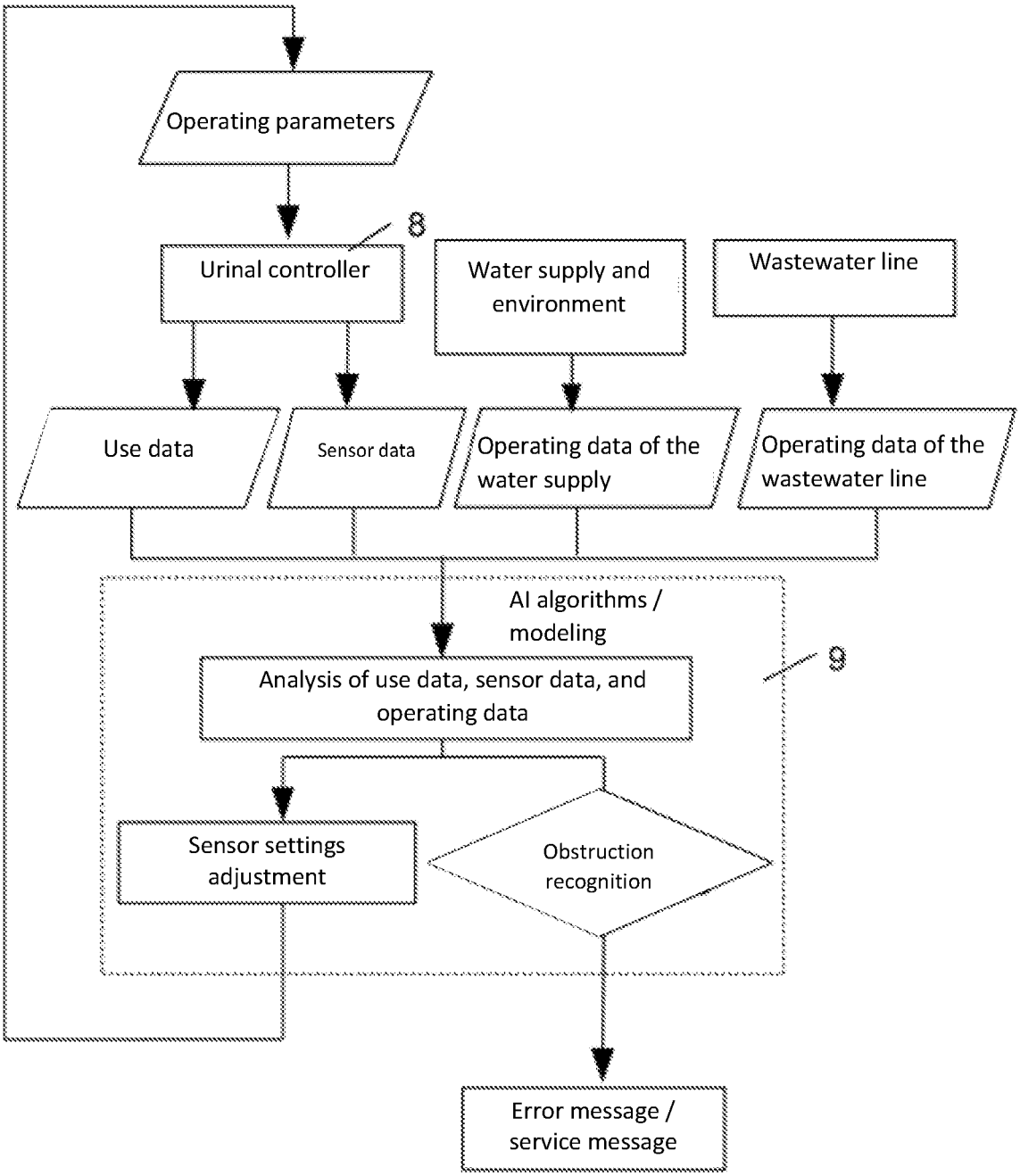
FIG. 4: is a flow chart for recognizing a reaction to an obstruction of an embodiment of a urinal system according to the invention.

FIG. 4 shows a flow chart for recognizing and reacting to an obstruction in an embodiment of a urinal system 10 according to the invention. The same reference numerals are used here as above; reference is made to the description above.

The urinal controller 8 is coupled to at least one HF motion sensor 5 for detecting various parameters and to at least one actuator for triggering a flush. The parameters recognized by the at least one HF motion sensor 5 are urinal use, flowing flush water 6, drainage behavior and speed, as well as fluid 13 being in the urinal bowl 1 in the form of retained water.

The at least one actuator in this case is an inlet valve 3 which, in the embodiment shown, is designed as a solenoid valve.

The urinal controller 8 captures usage data and sensor data. The usage data contains, for example, the water consumption of the urinal system 10, usage statistics, or the profile of a usage process over time. The sensor data contains a flush water flow, the drain rate, and/or the presence of an obstruction and/or fluid 13 located in the urinal bowl 1, such as retained water, for example.

For the water supply of the urinal system 10, parameters such as water pressure, flow rate, water quality and/or water temperature are captured as operating data of the water supply. For this purpose, at least one pressure sensor 12 and/or at least one flow sensor and/or at least one temperature sensor are arranged in the fluid inlet 2. For example, water quality data relate to the lime content of the water.

For a wastewater line connected to the urinal outlet 4, the flow rate and/or a possible obstruction are captured as operating data of the wastewater line.

The usage data and sensor data from the urinal controller 8, the operating data of the water supply and the operating data of the wastewater line is then analyzed with the help of AI algorithms. An analysis of the drainage behavior, a trend analysis to detect changes, the detection of existing and beginning obstructions, the detection of a declining drainage performance, and/or the detection of service requirements are carried out.

If the urinal system 10 is completely obstructed, fluid builds up in the urinal bowl 1, as can be seen schematically in FIG. 2. If the capture area 7 of the HF motion sensor 5 in the urinal bowl 1 shown in FIG. 1 is filled with fluid, the HF motion sensor 5 no longer detects a flow of fluid because the HF signal from the HF motion sensor 5 typically cannot penetrate the standing fluid 13. In this situation, no use is detected and, if the device is completely obstructed, no flushing is detected.

With the present invention, this situation can be recognized without delay. Due to the gradually-increasing re-fill time of fluid in the urinal system 10, the trend analysis carried out by the data processing system 9 results in the decision that obstruction is beginning. When evaluating the re-fill time, environmental conditions such as water pressure, cleaning, optionally flushing of further fittings, etc. can be taken into account.

If an obstruction, a beginning obstruction or a decreasing drainage capacity is detected in the urinal system 10, the urinal controller 8 and/or the data processing system 9 sends an error message and/or service message to the building operator, a plumber, a building management system and/or a cloud. The drain should then be checked and, if necessary, a water seal in the urinal system 10 should be changed.

If neither an obstruction nor a beginning obstruction or a declining drainage capacity is detected, settings on the urinal system 10 may be adjusted, such as adjusting the flushing time or adjusting the flushing interval. With the adjustment of the flushing time and/or the flushing interval, the operating parameters are adjusted, which in turn are transmitted to the urinal controller.

Figure 5:
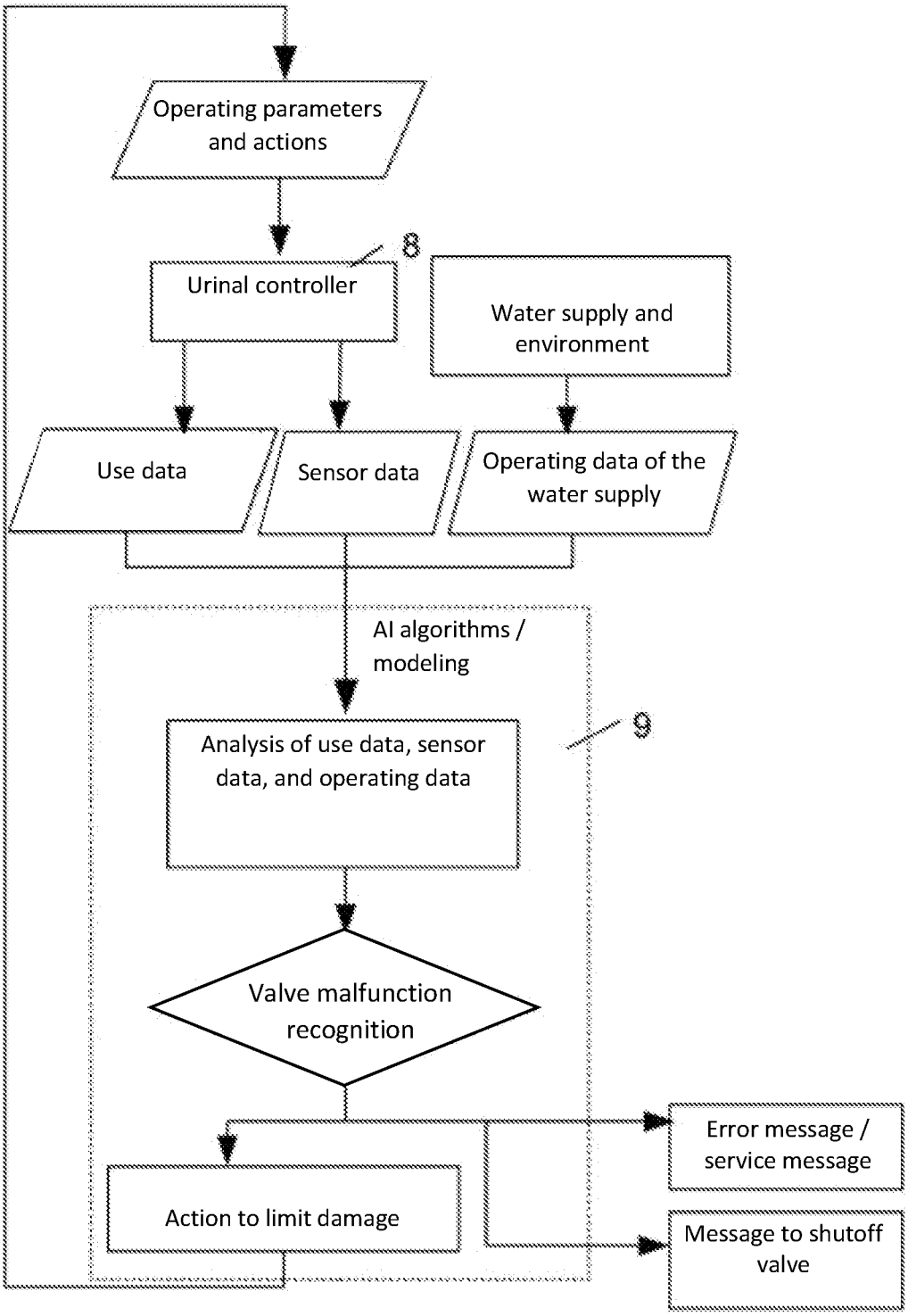
FIG. 5: is a flow chart for valve diagnosis in an embodiment of a urinal system according to the invention.

FIG. 5 is a flow diagram for valve diagnosis on an inlet valve 3 of an embodiment of a urinal system 10 according to the invention, which is designed in accordance with or similar to the embodiment of FIGS. 1 and 2, to which reference is made below.

In the method shown in FIG. 5 and carried out with the urinal system 10, operating parameters are detected and/or stored continuously or at predetermined time intervals by the urinal controller 8 of the urinal system 10. Such operating parameters can, for example, also be operating parameters initiated by the urinal controller 8 itself, such as a flushing time at one or more urinals of the urinal system 10 and/or actions carried out on the urinal system 10, such as the opening and/or closing of at least one inlet valve 3 of the urinal system 10.

The urinal controller 8 is coupled to at least one HF motion sensor 5 arranged on the urinal bowl 1 and/or the urinal outlet 4. The urinal controller 8 can also form a structural unit with the at least one HF motion sensor 5.

The at least one HF motion sensor 5, together with the urinal controller 8, for example, detects a urinal use and/or flowing flush water 6 and/or a drainage behavior at a urinal and/or a drainage speed at the urinal and/or fluid 13, such as retained water, in the urinal bowl 1.

Furthermore, as already mentioned above, the urinal controller 8, which is also coupled to at least one inlet valve 3 provided in the fluid inlet 2, and can control it, detects and/or saves actions performed at the inlet valve 3, such as triggering a flush and the duration thereof.

The data captured and/or stored by the urinal controller 8 can be subdivided into usage data and sensor data.

The usage data can contain data on the water consumption of the urinal system 10 and/or on the usage statistics of the urinal system 10 and/or on the chronological profile of uses of the urinal system 10.

The sensor data can include data on the flush water flow in the urinal system 10 and/or on the flow rate in the urinal system 10 and/or on an obstruction in the urinal system 10 and/or on the presence of retained water in the urinal bowl 1 and/or on a flow profile at the inlet valve 3.

In addition, operating data from a water supply connected to the urinal system 10 and/or from the surroundings of the urinal system 10 is captured for the urinal system 10. Such operating data can, for example, be a water pressure detected with the pressure sensor 12 provided in the fluid supply line 2 and/or a water flow rate detected in the fluid supply line and/or data on the water quality, such as lime content, the water supplied to the urinal system 10 and/or the water temperature of the water supplied to the urinal system 10.

The usage data, the sensor data and the operating data are processed by the data processing system 9. The data processing system 9 works using artificial intelligence (AI) methods and on the basis of modeling.

Each of the following processes can be carried out individually or in combination in the data processing system 9 on the basis of an analysis of the sensor data, the usage data and the operating data of the water supply:

- Analysis of pressure and/or flow rate during a flushing process in the urinal system 10
- Analysis of a water flow during a flushing process in the urinal system 10
- Analysis of a drainage behavior in the urinal system 10
- Trend analysis
- Detection of changes to the urinal system 10
- Detection of at least one valve malfunction at the inlet valve 3 in the event of a failure to open or a failure to close
- Detection of insufficient flow in the urinal system 10
- Analysis of a power consumption at the inlet valve 3 to detect electrical valve malfunctions and/or to draw conclusions about a water flow in the inlet valve 3.

If at least one of these processes detects a valve malfunction at the inlet valve 3, the data processing system 9 triggers at least one damage limitation step.

Such a step can be, for example, triggering a repeated valve closing process on the inlet valve 3 and/or prevent further opening of the inlet valve 3, for example until the next service appointment, and/or adapting a flushing time of the urinal system 10 to a detected flow of fluid through the fluid supply line 2. The step or steps taken to limit the damage are incorporated as control data in the operating parameters of the urinal system 10 mentioned at the outset, stored by the urinal controller 8, and included in further analyses by the data processing system 9.

Additionally or alternatively, the data processing system 9 can send at least one message to a device operator, a plumber, a building management system, and/or a cloud. This message can contain information and/or data on the presence of an obstruction and/or other malfunction in the urinal system 10. The message can also contain specific instructions at this point, such as instructions for removing the obstruction and/or for checking the drainage and/or for changing a water seal on the urinal system 10.

Furthermore, the data processing system 9 preferably transmits a signal to a main shut-off valve. As a result of this signal, the water supply to the urinal system 10 is shut off if the inlet valve 3 does not close.

Figure 6:
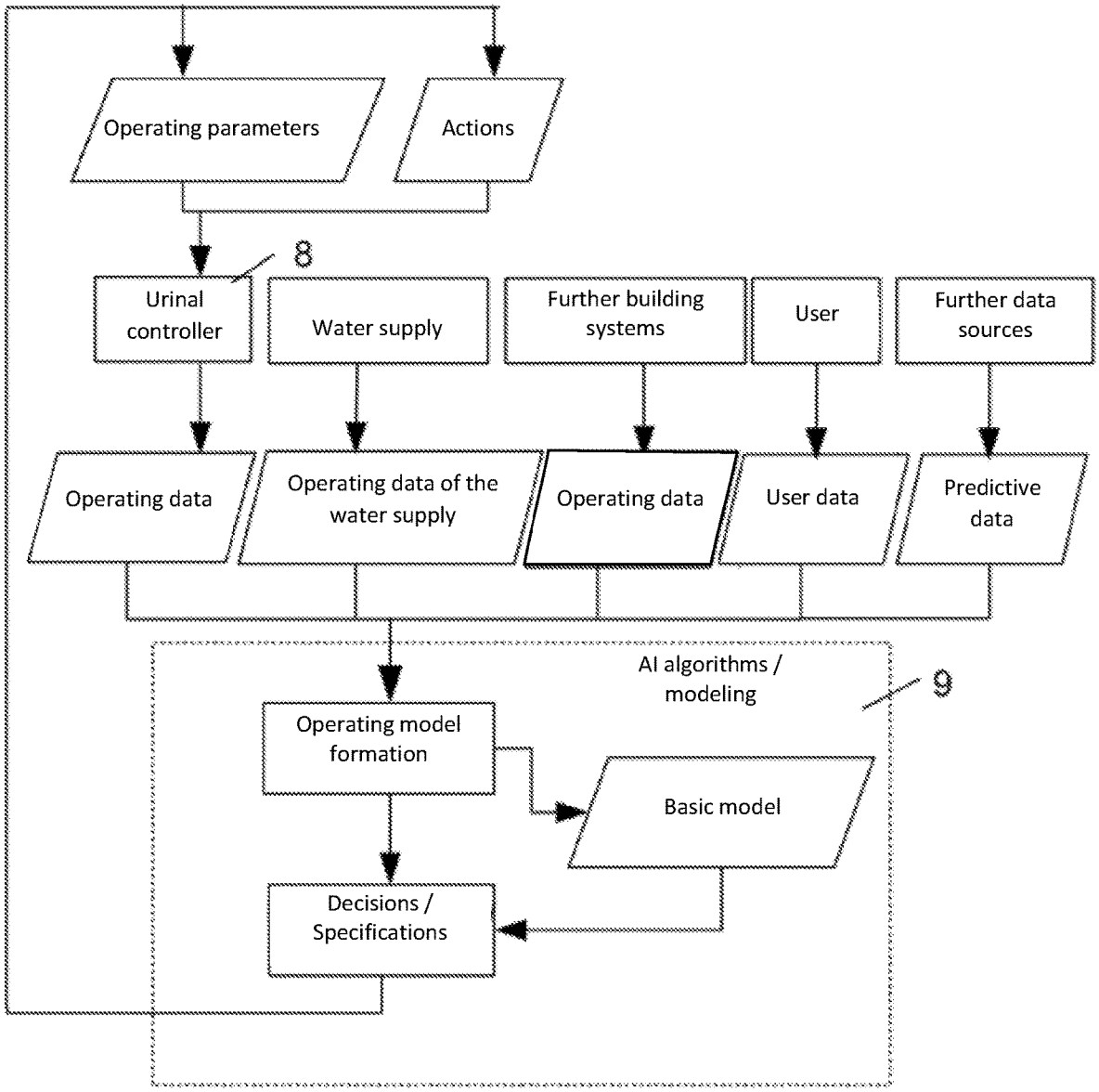
FIG. 6: is a flow chart for saving water in an embodiment of a urinal system according to the invention.

FIG. 6 shows a flow diagram of processes in an embodiment of a urinal system 10 according to the invention, which can be used to save water. The urinal system 10 shown in FIGS. 1 and 2, to which reference is made below, or a similar urinal system can again be used as the urinal system 10.

In the method shown in FIG. 6 and carried out in the urinal system 10, operating parameters of the urinal system 10 are captured and/or stored by a urinal controller 8 continuously or at predetermined time intervals. Such operating parameters can, for example, be a flushing volume in one or more urinals of the urinal system 10 and/or a sensitivity of at least one sensor used in the urinal system 10 and/or a maximum cycle time of the urinal system 10 and/or a flow through the urinal system 10 and/or a hybrid mode of the urinal system 10 and/or a water saving program set in the urinal system 10 and/or actions carried out in the urinal system 10, such as opening and/or closing at least one inlet valve 3 of the urinal system 10 and/or a cleaning procedure lock and/or switching off of a water supply to the urinal system 10 and/or performing a thermal disinfection on the urinal system 10 and/or activating lighting in the urinal system 10 and/or other product-specific actions in the urinal system 10.

The captured and/or stored operating parameters and actions are processed in a data processing system 9.

The urinal controller 8 is coupled to the at least one HF motion sensor 5 to detect uses of the urinal system 10, and to the inlet valve 3 to trigger a flush; the latter can be a solenoid valve, for example.

In the exemplary embodiment shown, the urinal controller 8 is, unlike in FIGS. 1 and 2, connected to the data processing system 9 formed separately from the urinal controller 8, which in other embodiments of the invention, as can be seen in FIGS. 1 and 2, can also be part of the urinal controller 8.

In the exemplary embodiment shown in FIG. 6, the urinal controller 8 transmits operating data, which can contain, for example, data on water consumption in the urinal system 10, flow data, data on water pressure in the urinal system 10, data on a chronological profile of water consumption, flow rate and/or water pressure in the urinal system 10 and/or on the user frequency of the urinal system 10, to the data processing system 9.

In the example of FIG. 6,

- operating data from a water supply of the urinal system 10, which can contain data on water pressure, flow rate and/or their respective chronological profile, and/or
- operating data of a further building system, such as a light controller and/or a door controller, which can contain, for example, access data from door controllers and/or data from motion or presence detectors of the light controller, and/or user data from users using the urinal system 10 and/or the building in which the urinal system 10 is located, such as data on presence, age, gender, mood and/or user feedback from users, and/or data from other data sources, such as at least one transit timetable, at least one flight schedule, at least one cleaning schedule, at least one game time, opening times and/or data of at least one weather forecast, from which predictive data is created is/are transmitted to the data processing system 9 in addition to the operating data from the urinal controller 8.

The data processing system 9 uses artificial intelligence algorithms and at least one modeling function for the further processing of the transmitted data.

In the exemplary embodiment shown in FIG. 6, the data processing system 9 creates an operating model by establishing a correlation between the operating data transmitted from the different sources, establishes interactions between various elements, such as between the water supply and water consumers of a water consumer system in which the urinal system 10 is integrated, and recognizes and predicts usage scenarios.

Such usage scenarios can, for example, be classified by the data processing system 9 into normal operation with occasional use of the urinal system 10, a temporary high frequency of use of the urinal system 10, for example during an intermission in a theater, a standby period when the urinal system 10 is not being used, a cleaning or service operation, or other application-specific scenarios.

The data processing system 9 preferably already contains a basic model of the installation for describing the water supply, the water consumers of the water consumer system, the further building systems, the influence of the predictive data, the users, and the interactions between these elements. This model can preferably be further developed by the data processing system 9 continuously or step by step, and thereby improved.

From the operating model and the basic model, decisions and/or proposals are preferably created by the data processing system 9 which, for example, relate to or include predicting usage situations and/or optimizing the operating parameters, such as optimizing the consumption of water and/or other consumed supplies of the urinal system 10 or the water consumption system, optimizing the user experience of users of the urinal system 10 or the water consumer system, and/or optimizing service of the urinal system 10 or the water consumer system, and/or triggering actions on the urinal system 10 or the water consumer system, and/or outputting at least one piece of information to the user and/or to a building management and/or a plumber.

The decisions and/or suggestions are included as control data in the operating parameters of the urinal system 10 mentioned at the outset, stored by the urinal controller 8, and included in further analyses by the data processing system 9.

The exemplary embodiments explained above can also be combined with each other.

In the present invention, malfunctions in the at least one HF motion sensor 5 can also be detected. In some cases, different malfunctions in the HF motion sensor 5 can lead to the same or similar effects. If, for example, the HF motion sensor 5 does not detect flushing water flowing during a flush, this can be due to the following causes:

complete obstruction, whereby the HF motion sensor 5 does not detect any motion because it is "blind,"

malfunction in the inlet valve 3 or electronics malfunction resulting in the inlet valve 3 not opening, malfunction in the water supply and/or absence of water supply to the urinal.

A distinction between these situations can be made in the data processing system 9 by combining the signals from the HF motion sensor 5 with one or more of the following additional pieces of information:

at least one pressure sensor 12 in the fluid supply line 2 detects whether the water supply is intact, at least one flow sensor in or on the fluid supply line 2 detects independently of the at least one HF motion sensor 5 whether water is flowing, information from other sensors as to whether other sensors have detected a malfunction in the water supply, plausibility/learning of typical signal processes (for example, a complete obstruction is unlikely immediately after a use is detected)

sensory detection of complete obstruction.

The corresponding situations can be recognized and distinguished from each other in the data processing system 9 on the basis of typical signal profiles in conjunction with data from further sensors with the aid of a classifier and using methods of artificial intelligence.

By combining the data from various sources and methods of artificial intelligence, functions are enabled according to the invention that are not possible with a conventional sensor or are only possible through human decisions and human intervention.

For example, the present invention enables the following applications:

For example, a) a flushing volume regulation and/or a pressure warning is possible as follows:

A urinal system 10 is flushed by opening an inlet valve 3 for a defined time. The flushing time is usually set so that a desired amount of water (flushing volume) flows into the urinal bowl 1 at a defined water pressure (nominal pressure, usually 3 bar). The actual flushing volume depends on the actual water pressure and can vary significantly from the desired flushing volume.

A flushing volume which is too low can lead to increased urine scale formation or bacterial growth in the water seal or in the drain pipe as a result of insufficient replacement of the water seal of the urinal system 10, and consequently to an obstruction. Too high a flushing volume unnecessarily increases water consumption.

If the water pressure is low, it may not be possible to achieve adequate replacement of the water seal even by extending the flushing time. This can quickly lead to obstruction.

By networking the urinal flush system, for example via a wireless or mesh data transmission network, such as Bluetooth or Bluetooth mesh, with the pressure sensor 12 or a flow sensor, or by integrating the pressure sensor 12 or a flow sensor directly into the urinal flush system of the urinal system 10, the flushing time can be adjusted as a function of the actual water pressure or the flow rate, so that the flushing volume can be set much more precisely (flushing volume regulation).

If the water pressure or flow falls below a certain minimum for a certain time, a diagnosis message can be triggered to inform a responsible person about the increased risk of obstruction and to initiate appropriate measures.

Furthermore, b) an obstruction or risk of obstruction can be recognized and reported as follows:

In the event of a complete or partial obstruction of the urinal outlet 4, fluid accumulates in the urinal bowl. In this situation, the at least one HF motion sensor 5 does not recognize a use, and the urinal controller 8 also does not initiate any flushing until the obstruction is cleared. This situation is usually only recognized by users or cleaning staff after complete obstruction, and then leads to complaints and/or service calls.

The at least one HF motion sensor 5, in combination with the urinal controller 8 and the data processing system 9 connected to it, effects an evaluation of the flow and drainage behavior in the urinal system 10 during and after flushing. In this way, when "no drainage" is detected, it is recognized that there may be a complete obstruction, and when "changed drainage behavior" is detected, it is recognized that there may be a beginning obstruction. By means of a trend analysis carried out in the data processing system 9, which is carried out over a longer period of time, a beginning obstruction can thus be predicted in good time.

A complete obstruction of one or more urinals of the urinal system 10 can also be detected by sensors by evaluating sensor signals from the at least one HF motion sensor 5 or another sensor, as explained above under point a).

To assess the risk of obstruction, the data processing system 9 can also use additional data, if available, such as the water quality, such as the lime content of the water, the flow rate in the wastewater disposal system, information about the gradient of wastewater lines, or the given temperature. All of these factors can, for example, influence urine scale formation and bacterial growth and thus the risk of obstruction.

If a complete or partial obstruction is detected, a diagnostic message can be output by means of the data processing system 9.

In addition, it is c) possible to carry out an expanded valve diagnosis of the urinal system 10 as follows:

Inlet valves 3 in the form of solenoid valves are used to control the water flow for flushing urinals and other electronic products in the water sector. As electronic components, solenoid valves are always a weak point in the system due to their limited service life, for example due to contamination. Defective solenoid valves can lead to a functional failure of the urinal system 10 in which no flushing is carried out, and/or can lead to continuous operation of the urinal system 10 if they do not perform a closing function.

In contrast, the present invention enables valve diagnosis of the inlet valve 3.

The at least one HF motion sensor 5 can detect the flowing and draining fluid in the event of a flush. It can thus be recognized with the urinal system 10 according to the invention whether water is flowing during a flush and whether the water flow stops again after the flush. Through a combination with data from other networked sensors, such as pressure sensor(s) 12 and/or flow sensor(s) in the fluid supply line 2, and/or a detection of the flow behavior in the drain of the urinal system 10, it is possible in embodiments of the present invention to distinguish between a valve malfunction and situations such as a use directly after a flush, a cleaning, and a shut-off water supply, among other things. For this purpose, rules and methods of artificial intelligence, such as learning typical usage situations, can be used by the data processing system 9.

In the event a valve malfunction is detected, the data processing system 9 can trigger a diagnostic message. If the malfunction leads to a permanent flow of water, the water supply of the affected area—such as a room—can be shut off in cooperation with a main shutoff valve, for example via a wireless or mesh data transmission network 14, such as Bluetooth or Bluetooth mesh.

Finally, d) the present invention allows for the possibility of a usage profile analysis proceeding as follows, and/or the application of the water-saving algorithms described as follows:

A standard function of urinal sensors in the prior art is a flush after each use of the urinal. For installations with high user frequency, such as in public buildings, stadiums, etc., water-saving programs can be implemented in known sanitary products that reduce the number of flushes in certain operating situations. The rigid controls of these operating modes mean that these programs do not come into effect in many installations, because, for example, the criteria of a stadium mode are not met despite high user frequency, or the ease of use is unnecessarily restricted, so that, for example, fewer flushes are performed despite low user frequency.

In the present invention, however, an analysis of the actual usage profile of a urinal system 10 is performed. In this case, typical usage scenarios of the urinal system 10 are recognized over a longer period of time, times of high usage of the urinal system 10 are identified, and suitable and effective water-saving programs are activated for the given situation.

In addition to the operating data of the at least one HF motion sensor 5, the analysis of the usage profiles can also include further data from other products, such as data from other sanitary products in the room, which provide a measure of how often the room is used, schedules/opening times of a building, theater schedules and/or airport flight schedules, etc., in order to predict times of high traffic and to activate water-saving programs tailored to the given situation. In this way, a flush interval and the flushing volume can be adapted to an expected number of users, and a cleaning flush with a high flushing volume can be triggered at suitable times.

Intervention by the respective user or building operator is possible in principle, but not necessary for the present invention to function.

With the aid of the present invention it is also possible to optimize the cleaning cycles of the urinal system 10. For example, consumables such as soap or towels can be replenished before anticipated traffic, and cleaning can be carried out after a use frequency.

The invention claimed is:

1. Urinal system comprising a urinal bowl, a fluid inlet with an inlet valve, a urinal outlet, at least one HF motion sensor for detecting fluid motion provided on the urinal bowl and/or at the urinal outlet and a urinal controller coupled with the at least one HF motion sensor and the inlet valve, wherein the urinal controller comprises a data processing system and/or is connected to a data processing system, which is arranged to (i) obtain data captured by the HF motion sensor, (ii) evaluate the data arithmetically and (iii) based on the evaluated data, identify at least one of the following malfunctions:

the urinal outlet is obstructed, the fluid inlet is malfunctioning, the inlet valve is malfunctioning, and there is a malfunction of the at least one HF motion sensor, wherein the data processing system comprises at least one data processing block that is machine-learning and/or comprises an artificial neuronal net and/or includes an expert system.

2. The urinal system of claim 1, wherein the urinal system comprises an error message and/or service notification output unit coupled with the data processing system.

3. The urinal system of claim 1, wherein the data processing system is arranged to identify at least one of a predefined urinal usage situation and frequency of use based on the evaluated data, and adjust at least one of an opening time, an opening position and an opening frequency of the inlet valve based thereon during at least one subsequent urinal flushing process.

4. Water consumer system comprising a urinal system according to claim 1, wherein the water consumer system comprises at least one additional water consumer in addition to the urinal system, where at least one additional sensor is provided, wherein the data processing system is coupled with the at least one additional sensor and is arranged to arithmetically evaluate the data captured by the at least one additional sensor and received by the data processing system and to include the data into the detection and/or prevention of at least one of the malfunctions.

5. The water consumer system of claim 4, wherein the water consumers and the urinal system are connected with each other via a meshed and/or a wireless local data transmission network.

6. The urinal system of claim 1, wherein the urinal system further comprises at least one pressure sensor and/or at least one flow sensor in the fluid inlet and/or is coupled with at least one pressure sensor and/or at least one flow sensor in the fluid inlet via a meshed data transmission network, wherein the data processing system is further arranged to (i) obtain data captured by at least one of the pressure sensor and the flow sensor, (ii) evaluate the data arithmetically and (iii) based on the evaluated data, identify at least one of the following malfunctions:

the urinal outlet is obstructed, there is a pressure fluctuation in a wastewater system connected to the urinal system, pressure in the fluid inlet has dropped below a minimum pressure value, or has exceeded a maximum pressure value, and the fluid inlet or the inlet valve is malfunctioning.

7. The urinal system of claim 1, wherein the inlet valve is arranged to open for a predefined time if draining fluid is detected by the HF motion sensor.

8. Method for operating a urinal system comprising a urinal bowl, a fluid inlet with an inlet valve, a urinal outlet, at least one HF motion sensor for detecting fluid motion provided on the urinal bowl and/or at the urinal outlet and a urinal controller coupled with the at least one HF motion sensor and the inlet valve, wherein the urinal controller comprises a data processing system and/or is connected to a data processing system, which (i) obtains data captured by the at least one HF motion sensor, (ii) evaluates the data arithmetically and, (iii) based on the evaluated data, recognizes when there is one of the following malfunctions:

the urinal outlet is obstructed, the fluid inlet is malfunctioning, the inlet valve is malfunctioning, there is a malfunction of the at least one HF motion sensor, wherein the data processing system comprises at least one data processing block that is ma-chine-learning and/or comprises an artificial neuronal net and/or includes an expert system.

9. The method of claim 8, wherein a fluid pressure is captured by means of at least one pressure sensor and/or a fluid flow is captured by means of at least one flow sensor in the fluid inlet, the captured fluid pressure and/or the captured fluid flow is/are transmitted to the data processing system, the data processing system arithmetically evaluates the captured fluid pressure and/or the captured fluid flow along with the data obtained by the at least one HF motion sensor and, based on the evaluated data, recognizes when there is at least one of the following malfunctions and/or triggers at least one action in order to prevent at least one of the following malfunctions:

the urinal outlet is obstructed, there is a pressure fluctuation in a waste water system connected to the urinal system, the pressure in the fluid drops below a minimum pressure value or exceeded a maximum pressure value, the fluid inlet or the inlet valve is malfunctioning.

10. The method of claim 9, wherein the data processing system recognizes that the urinal outlet is partially blocked and/or the fluid inlet is faulty, if it is detected by the at least one HF motion sensor that there is a delayed drainage of fluid from the urinal bowl even though the inlet valve is opened.

11. The method of claim 10, wherein the data processing system recognizes, whether the urinal outlet is partially blocked or the fluid inlet is faulty when it is detected by the at least one HF motion sensor that fluid drains from the urinal bowl with a delay even though the inlet valve is opened and fluid pressure has been captured by the at least one pressure sensor and/or fluid flow has been captured by the at least one flow sensor.

12. The method of claim 9, wherein a respective opening time of the inlet valve is adjusted to the respective fluid pressure and/or the respective fluid flow in the fluid inlet by the urinal controller.

13. The method of claim 8, wherein the inlet valve opens for a predefined time if draining fluid is detected by the HF motion sensor.

14. The method of claim 8, wherein the data processing system recognizes that the urinal outlet is blocked and/or the fluid inlet is faulty, if no draining fluid is detected by the HF motion sensor even though the inlet valve is open and/or it is detected by means of the at least one HF motion sensor that at least a lower area within the urinal bowl is filled with standing fluid.

15. The method of claim 14, wherein the data processing system recognizes whether the urinal outlet is blocked or the fluid inlet is faulty, if no draining fluid is detected by the at least HF motion sensor even though the inlet valve is opened and fluid pressure has been captured by the at least one pressure sensor and/or fluid flow has been captured by the at least one flow sensor and/or it is detected by means of the at least one HF motion sensor that at least a lower area within the urinal bowl is filled with standing fluid.

16. The method of claim 8, wherein the data processing system recognizes that the fluid inlet is faulty, if the at least one HF motion sensor detects no fluid flow and/or a permanent fluid flow and/or a fluid flow beneath a fluid flow threshold value.

17. The method of claim 8, wherein the urinal system comprises an error message and/or service notification output unit coupled with the data processing system and that the data processing system puts out a service notification to the error and/or service notification output unit when it recognizes at least one of the malfunctions.

18. The method of claim 8, wherein the data processing system recognizes that there is a pressure fluctuation in the waste water system connected to the urinal bowl if a series of consecutive faulty urinal flushing processes on the urinal system results from the process of the data of the at least one HF motion sensor and/or a signal pattern of the data of the at least one HF motion sensor corresponds to a characteristic fluctuation of the fluid level in the urinal outlet.

19. The method of claim 8, wherein when the data processing system recognizes that there is a pressure fluctuation in a waste water system connected to the urinal system, the urinal controller changes a sensitivity of the at least one HF motion sensor and/or when a signal pattern of the data of the at least one HF motion sensor corresponds to a characteristic fluctuation of the fluid level in the urinal outlet, does not initiate a urinal flushing process.

20. The method of claim 8, wherein the data processing system comprises at least one data processing block, which is machine-learning and/or works based on an artificial neuronal net and/or is an expert system.

21. The method of claim 8, wherein the urinal system is integrated into a water consumer system, which comprises at least one additional water consumer in addition to the urinal system, where at least one additional sensor is provided, wherein the data processing system is coupled with the at least one additional sensor and also arithmetically evaluates the data received by the at least one additional sensor, wherein at least one flushing time and/or blockage in an outlet and/or pressure fluctuation in a waste water system and/or defect of an inlet device of the at least one additional water consumer determined thereby, is included in the detection of at least one of the malfunctions.

22. The method of claim 21, wherein the water consumers and the urinal system communicate with each other via a meshed and/or a wireless local data transmission network.

23. The method of claim 8, wherein there is a malfunction of at least one of the at least one HF motion sensor if the data processing system does not receive data from at least one of the at least one HF motion sensor or the data of at least one of the at least one HF motion sensor received by the data processing system are not processible by the data processing system and/or at least one of the at least one HF motion sensor issues at least one service signal.

* * * * *